US010385507B2

(12) United States Patent
Aikawa

(10) Patent No.: US 10,385,507 B2
(45) Date of Patent: Aug. 20, 2019

(54) REFINER BEATING METHOD

(71) Applicant: AIKAWA IRON WORKS CO., LTD., Shizuoka (JP)

(72) Inventor: Masaki Aikawa, Shizuoka (JP)

(73) Assignee: AIKAWA IRON WORKS CO., LTD., Shizuoka-Shi, Shizuoka (JP)

( * ) Notice: Subject to any disclaimer, the term of this patent is extended or adjusted under 35 U.S.C. 154(b) by 447 days.

(21) Appl. No.: 15/174,237

(22) Filed: Jun. 6, 2016

(65) Prior Publication Data

US 2016/0362835 A1 Dec. 15, 2016

(30) Foreign Application Priority Data

Jun. 10, 2015 (JP) ..... 2015-117405

(51) Int. Cl.

| | |
|---|---|
| ***D21D 1/30*** | (2006.01) |
| ***D21D 1/04*** | (2006.01) |
| ***B02C 7/12*** | (2006.01) |
| ***B02C 7/00*** | (2006.01) |
| ***B02C 7/02*** | (2006.01) |
| ***D21D 1/22*** | (2006.01) |

(52) U.S. Cl.

CPC ..... *D21D 1/04* (2013.01); *B02C 7/00* (2013.01); *B02C 7/02* (2013.01); *B02C 7/12* (2013.01); *D21D 1/22* (2013.01); *D21D 1/30* (2013.01); *D21D 1/303* (2013.01)

(58) Field of Classification Search

CPC ..... D21D 1/30; D21D 1/303; D21D 1/04; D21D 1/22; B02C 7/12; B02C 7/02

USPC ..... 241/84, 86, 89.3, 261.1–261.3, 297–297

See application file for complete search history.

(56) References Cited

U.S. PATENT DOCUMENTS 4,401,280 A * 8/1983 Reinhall ..... B02C 7/11 241/247

5,127,591 A * 7/1992 Bernhard ..... D21B 1/14 241/259.1

(Continued)

FOREIGN PATENT DOCUMENTS

CN 102472007 A 5/2012

DE 102004039986 A1 12/2007

(Continued)

OTHER PUBLICATIONS

Europe Patent Office, "Search Report for European Patent Application No. 16173778.8," dated Oct. 14, 2016.

*Primary Examiner* — Faye Francis

(74) *Attorney, Agent, or Firm* — Manabu Kanesaka

(57) ABSTRACT

A refiner includes a main body, a rotation shaft provided inside the main body, a tapered rotor attached to the rotation shaft with a space therein, a stator provided in the main body, a rotor beating portion provided on the rotor and having a groove between bars and through-holes, a stator beating portion on the stator with a groove between bars and through-holes, a raw material supply portion for supplying a raw material into the main body, and a raw material discharge portion for discharging a beaten raw material outside the main body. A portion of the raw material guided to a small-diameter opening portion of the rotor and the space of the rotor is beaten by passing through the through-holes of the rotor beating portion and the stator beating portion, and is discharged outside the stator beating portion from the through-holes of the stator beating portion.

6 Claims, 38 Drawing Sheets

(56) References Cited

U.S. PATENT DOCUMENTS

| | | | |
|---|---|---|---|
| 5,383,608 | A | 1/1995 | Dahiqvist et al. |
| 8,511,595 | B2 | 8/2013 | Lindroos et al. |
| 8,646,708 | B2 | 2/2014 | Halla |
| 9,222,220 | B2 | 12/2015 | Sjostrom et al. |

FOREIGN PATENT DOCUMENTS

| | | | |
|---|---|---|---|
| EP | 0618327 | A1 | 10/1994 |
| JP | 4518711 | B2 | 8/2010 |
| WO | 2009/153412 | A1 | 12/2009 |
| WO | 2012/101330 | A1 | 8/2012 |

* cited by examiner

REFINER BEATING METHOD

BACKGROUND

Technical Field

The present invention relates to a refiner beating method and a refiner and particularly to a refiner beating method and a refiner causing an increase in processing capability.

Related Art

A hitherto, a refiner is known as a device for beating pulp (for example, see JP 4518711 B2).

In the refiner, a raw material is beaten by a rotor blade and a stator blade.

However, since a gap formed between the rotor blade and the stator blade of the beating portion of the refiner is narrow, a large amount of a raw material cannot easily flow therebetween and hence processing capability is limited. Likewise, since the raw material to be processed passes through the narrow gap, there are problems in which pressure loss is large and processing capability cannot be increased with high efficiency.

The invention is made in view of the above-described circumstances and an object of the invention is to provide a refiner beating method and a refiner causing an increase in processing capability.

SUMMARY OF THE INVENTION

A refiner according to an invention comprises a main body, a rotation shaft provided inside the main body, a tapered rotor attached to the rotation shaft and having a space therein, a stator provided in the main body to oppose the rotor, a rotor beating portion provided on a surface of the rotor, the rotor beating portion having a groove between a bar and a bar and having a plurality of through-holes penetrating therethrough, a stator beating portion provided on a surface of the stator, the stator beating portion opposing the rotor beating portion, and having a groove between a bar and a bar and a plurality of through-holes penetrating therethrough, a raw material supply portion for supplying a raw material into the main body, and a raw material discharge portion for discharging a beaten raw material to an outside of the main body. The bar of the rotor beating portion is inclined such that the raw material is guided from a small diameter side of the rotor to a large diameter side of the rotor. The rotor is configured such that the small diameter side serves as a small-diameter opening portion and the large diameter side is blocked.

The raw material from the raw material supply portion approaches end portions of the stator beating portion and the rotor beating portion on a side close to the raw material supply portion, and the small-diameter opening portion of the rotor. The plurality of through-holes of the stator beating portion, and end portions of the stator beating portion and the rotor beating portion on a side far from the raw material supply portion communicate with the raw material discharge portion.

In a refining beating method, a portion of a raw material guided to the small-diameter opening portion of the rotor and the space of the rotor is beaten by passing through the plurality of through-holes of the rotor beating portion and the plurality of through-holes of the stator beating portion, and is discharged to an outside of the stator beating portion from the plurality of through-holes of the stator beating portion.

A portion of a raw material guided to the small-diameter opening portion of the rotor and the space of the rotor passes through the plurality of through-holes of the rotor beating portion on a side close to the large diameter side of the rotor, is beaten by passing through a gap between the stator beating portion and the rotor beating portion, and is discharged to an outside of the stator beating portion and the rotor beating portion from the end portions of the stator beating portion and the rotor beating portion on the side far from the raw material supply portion.

A raw material guided to between the stator beating portion and the rotor beating portion on the small diameter side corresponding to the end portions on the side closed to the raw material supply portion is beaten by passing through the stator beating portion and the rotor beating portion, and is discharged to the outside of the stator beating portion from the plurality of through-holes of the stator beating portion.

A refiner in one aspect of the invention comprises a main body; a rotation shaft provided inside the main body; a tapered rotor attached to the rotation shaft, and having a space inside the rotor; a stator provided in the main body to oppose the rotor; a rotor beating portion provided on a surface of the rotor, the rotor beating portion having a groove between a bar and a bar and a plurality of through-holes penetrating therethrough; a stator beating portion provided on a surface of the stator, the stator beating portion opposing the rotor beating portion, and having a groove between a bar and a bar, and a plurality of through-holes penetrating therethrough, a raw material supply portion for supplying a raw material into the main body; and a raw material discharge portion for discharging a beaten raw material to an outside of the main body, wherein the bar of the rotor beating portion is inclined such that a raw material is guided from a small diameter side of the rotor to a large diameter side of the rotor, the rotor is configured such that the small diameter side serves as a small-diameter opening portion and the large diameter side is blocked, the raw material from the raw material supply portion approaches end portions of the stator beating portion and the rotor beating portion on a side close to the raw material supply portion, and the small-diameter opening portion of the rotor, and the plurality of through-holes of the stator beating portion and end portions of the stator beating portion and the rotor beating portion on a side far from the raw material supply portion communicate with the raw material discharge portion.

A refiner according to another aspect of the invention comprises a main body; a rotation shaft provided inside the main body; a rotor attached to the rotation shaft and having a mountain shape in which a center is high, the rotor having first and second opening portions, both ends of which are open, and a space therein; a stator provided in the main body to oppose the rotor; a rotor beating portion provided on a surface of the rotor except for a center of the rotor in a longitudinal direction, the rotor beating portion having a groove between a bar and a bar, and a plurality of through-holes penetrating therethrough; a stator beating portion provided on a surface of the stator, the stator beating portion opposing the rotor beating portion and having a groove between a bar and a bar, and a plurality of through-holes penetrating therethrough; a first raw material supply portion provided in the main body to supply a raw material from a side of the first opening portion; a second raw material supply portion provided in the main body to supply a raw material from a side of the second opening portion; and a raw material discharge portion for discharging a beaten raw material to an outside of the main body, wherein the rotor beating portion includes a first rotor beating portion provided on a surface thereof and a second rotor beating portion provided on the surface, the first rotor beating portion having a first groove between a first bar and a first bar and having a plurality of first through-holes penetrating therethrough, the second rotor beating portion having a second groove between a second bar and a second bar and having a plurality of second through-holes penetrating therethrough; the stator beating portion includes a first stator beating portion provided on a surface thereof and a second stator beating portion provided on the surface, the first stator beating portion having a first' groove between a first' bar and a first' bar and having a plurality of first' through-holes penetrating therethrough, the second stator beating portion having a second' groove between a second' bar and a second' bar and having a plurality of second' through-holes penetrating therethrough; the first bar of the first rotor beating portion is inclined such that a raw material is guided from a small diameter side of a first rotor to a large diameter side of the first rotor, and the second bar of the second rotor beating portion is inclined such that a raw material is guided from a small diameter side of a second rotor to a large diameter side of the second rotor; a central opening portion is formed at a central portion of the stator beating portion; the raw material from the first raw material supply portion approaches end portions of the first stator beating portion and the first rotor beating portion on a side close to the first raw material supply portion, and the first opening portion; the raw material from the second raw material supply portion approaches end portions of the second stator beating portion and the second rotor beating portion on a side close to the second raw material supply portion, and the second opening portion; end portions of the first stator beating portion and the first rotor beating portion on a side far from the first raw material supply portion face the central opening portion; end portions of the second stator beating portion and the second rotor beating portion on a side far from the second raw material supply portion face the central opening portion, and the plurality of first' through-holes of the first stator beating portion, the plurality of second' through-holes of the second stator beating portion, and the central opening portion communicate with the raw material discharge portion.

A still another aspect of the refiner of the invention comprises a main body; a rotation shaft provided inside the main body; a rotor attached to the rotation shaft and having a mountain shape in which a center is high, the rotor having first and second opening portions, both ends of which are opened, and a space therein; a stator provided in the main body to oppose the rotor; a rotor beating portion provided on a surface of the rotor except for a center of the rotor in a longitudinal direction, the rotor beating portion having a groove between a bar and a bar and a plurality of through-holes penetrating therethrough; a stator beating portion provided on a surface of the stator, the stator beating portion opposing the rotor beating portion and having a groove between a bar and a bar, and a plurality of through-holes penetrating therethrough; a raw material supply portion for supplying a raw material, the raw material supply portion being provided in the main body closer to the first opening portion than to the second opening portion; and a raw material discharge portion for discharging a beaten raw material to an outside of the main body, wherein the rotor beating portion includes a first rotor beating portion provided on a surface thereof and a second rotor beating portion provided on the surface, the first rotor beating portion having a first groove between a first bar and a first bar and a plurality of first through-holes penetrating therethrough, the second rotor beating portion having a second groove between a second bar and a second bar and a plurality of second through-holes penetrating therethrough; the stator beating portion includes a first stator beating portion provided on a surface thereof and a second stator beating portion provided on the surface, the first stator beating portion having a first' groove between a first' bar and a first' bar and a plurality of first' through-holes penetrating therethrough, the second stator beating portion having a second' groove between a second' bar and a second' bar and a plurality of second' through-holes penetrating therethrough; the first bar of the first rotor beating portion is inclined such that a raw material is guided from a small diameter side of a first rotor to a large diameter side of the first rotor, and the second bar of the second rotor beating portion is inclined such that a raw material is guided from a small diameter side of a second rotor to a large diameter side of the second rotor; a central opening portion is formed at a central portion of the stator beating portion; the raw material from the raw material supply portion approaches end portions of the first stator beating portion and the first rotor beating portion on a side close to the raw material supply portion, and the first opening portion;

end portions of the first stator beating portion and the first rotor beating portion on the large diameter side face the central opening portion; end portions of the second stator beating portion and the second rotor beating portion on the large diameter side face the central opening portion, and the plurality of first' through-holes of the first stator beating portion, the plurality of second' through-holes of the second stator beating portion, and the central opening portion communicate with the raw material discharge portion.

A still further aspect of the refiner of the invention comprises a main body; a rotation shaft provided inside the main body; a rotor attached to the rotation shaft and having a mountain shape in which a center is high, the rotor having first and second opening portions, both ends of which are opened, and a space therein; a stator provided in the main body to oppose the rotor; a rotor beating portion provided on a surface of the rotor except for a center of the rotor in a longitudinal direction, the rotor beating portion having a groove between a bar and a bar and a plurality of through-holes penetrating therethrough; a stator beating portion provided on a surface of the stator, the stator beating portion opposing the rotor beating portion, and having a groove between a bar and a bar, and a plurality of through-holes penetrating therethrough; a first raw material supply portion provided in the main body to supply a raw material from a side of the first opening portion; a second raw material supply portion provided in the main body to supply a raw material from a side of the second opening portion; and a raw material discharge portion for discharging a beaten raw material to an outside of the main body, wherein the rotor beating portion includes a first rotor beating portion provided on a surface and a second rotor beating portion provided on a surface, the first rotor beating portion having a first groove between a first bar and a first bar and a plurality of first through-holes penetrating therethrough, the second rotor beating portion having a second groove between a second bar and a second bar and a plurality of second through-holes penetrating therethrough; the stator beating portion includes a first stator beating portion provided on a surface thereof and a second stator beating portion provided on the surface, the first stator beating portion having a first' groove between a first' bar and a first' bar and a plurality of first' through-holes penetrating therethrough, the second stator beating portion having a second' groove between a second' bar and a second' bar and a plurality of second' through-holes penetrating therethrough; the first bar of the first rotor beating portion is inclined such that a raw material is guided from a large diameter side of a first rotor to a small diameter side of the first rotor, and the second bar of the second rotor beating portion is inclined such that a raw material is guided from a large diameter side of a second rotor to a small diameter side of the second rotor; a central opening portion is formed at a central portion of the stator beating portion; end portions of the first stator beating portion and the first rotor beating portion on a side far from the first raw material supply portion face the central opening portion; end portions of the second stator beating portion and the second rotor beating portion on a side far from the second raw material supply portion face the central opening portion; the raw material from the first raw material supply portion approaches end portions of the first stator beating portion and the first rotor beating portion on a side close to the first raw material supply portion, and the first opening portion; the raw material from the second raw material supply portion approaches end portions of the second stator beating portion and the second rotor beating portion on a side close to the second raw material supply portion, and the second opening portion, and the plurality of first' through-holes of the first stator beating portion, the plurality of second' through-holes of the second stator beating portion, and the central opening portion communicate with the raw material discharge portion.

A still further aspect of the refiner of the invention comprises a main body; a rotation shaft provided inside the main body; a tapered rotor attached to the rotation shaft and having a space therein; a stator provided in the main body to oppose the rotor; a rotor beating portion provided on a surface of the rotor, the rotor beating portion having a groove between a bar and a bar and a plurality of through-holes penetrating therethrough; a stator beating portion provided on a surface of the stator, the stator beating portion opposing the rotor beating portion, and having a groove between a bar and a bar, and a plurality of through-holes penetrating therethrough; a raw material supply portion for supplying a raw material into the main body; and a raw material discharge portion for discharging a beaten raw material to an outside of the main body, wherein the raw material from the raw material supply portion approaches end portions of the stator beating portion and the rotor beating portion on a side close to the raw material supply portion, and a small-diameter opening portion of the rotor; the plurality of through-holes of the stator beating portion and end portions of the stator beating portion and the rotor beating portion on a side far from the raw material supply portion communicate with the raw material discharge portion; the rotor is configured such that a small diameter side serves as a small-diameter opening portion and a large diameter side is blocked, and the bar of the rotor beating portion is inclined such that a raw material is guided from the large diameter side of the rotor to the small diameter side of the rotor.

In the apparatus and method of the invention, a large amount of raw material flows through the beating portions. Thus, processing ability of the refiner can be increased.

DETAILED DESCRIPTION

A refiner beating method according to an embodiment of the invention will be described with reference to FIGS. 1 to 10.

Figure 1:
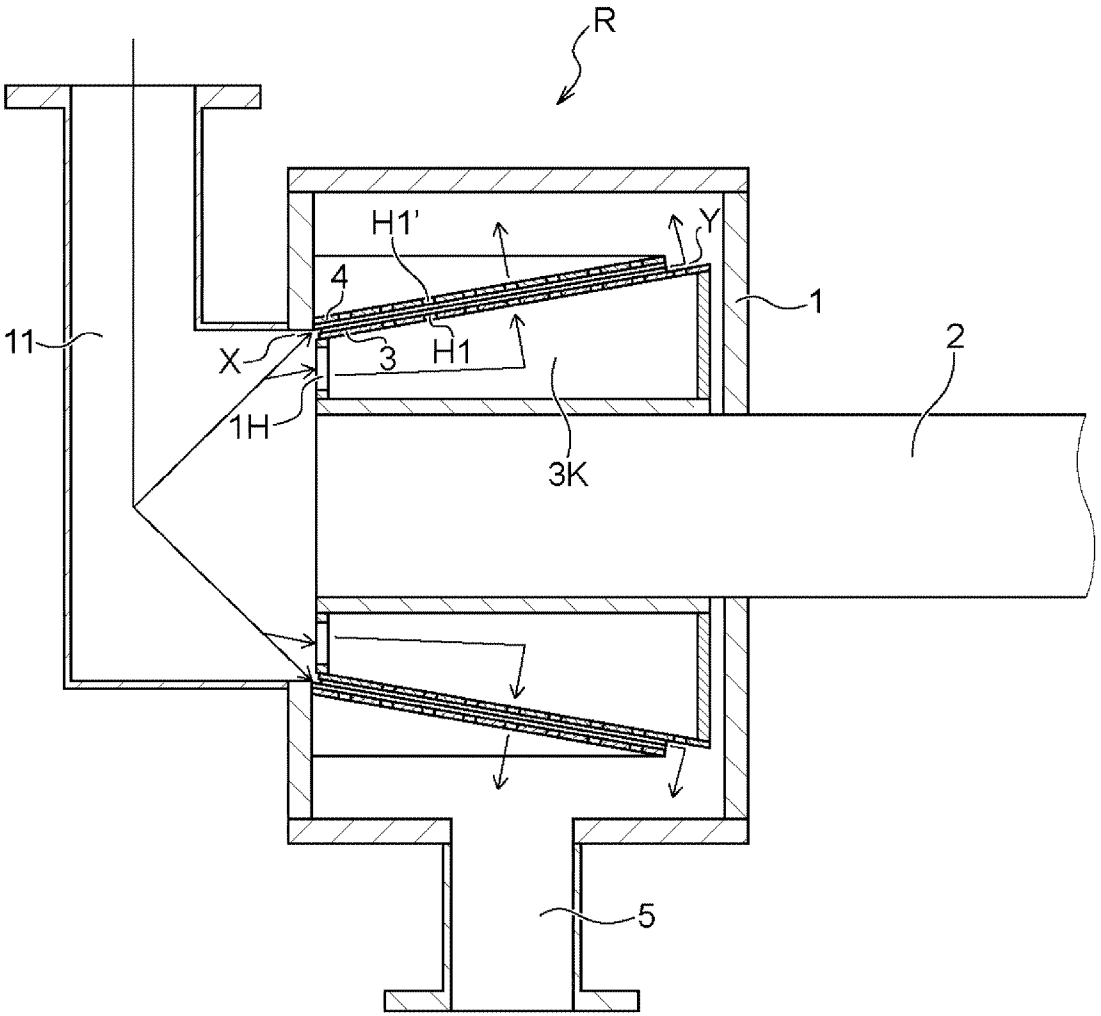
FIG. 1 is a schematic cross-sectional view illustrating a refiner used in a refiner beating method according to an embodiment of the invention.
Figure 2:
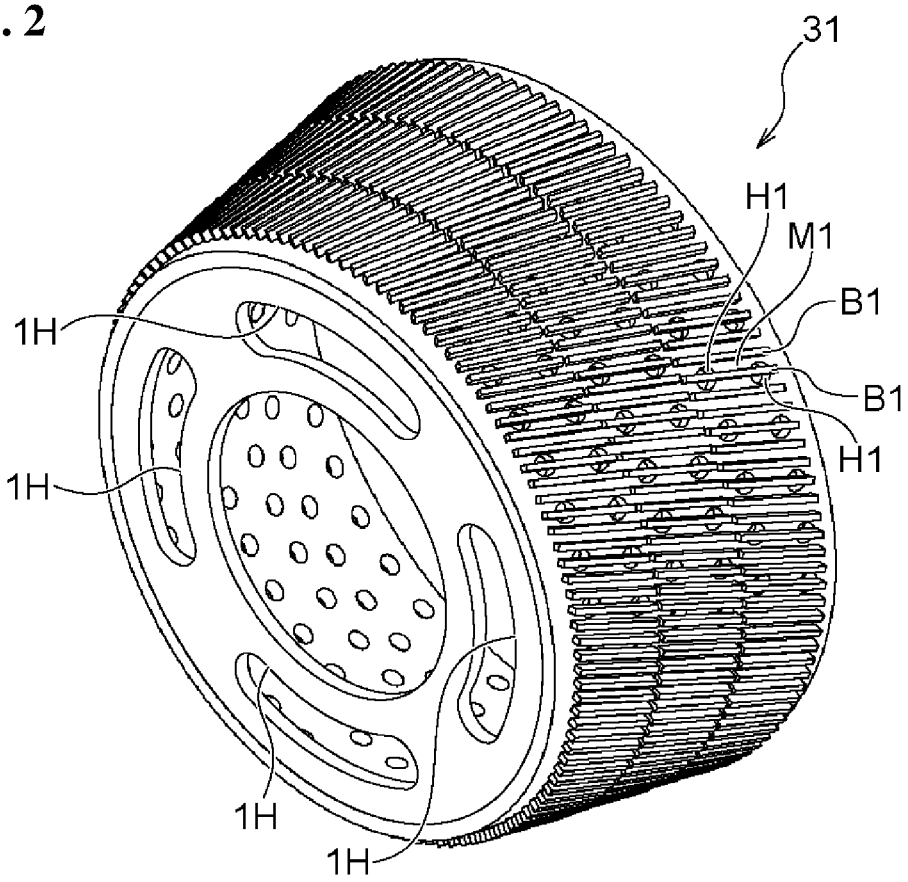
FIG. 2 is a schematic perspective view illustrating a rotor beating portion (rotor) of FIG. 1.
Figure 3:
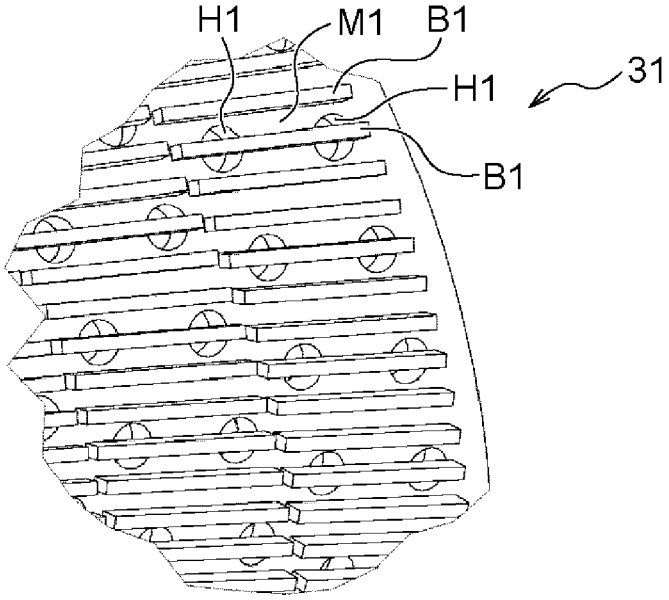
FIG. 3 is a schematic enlarged perspective view illustrating a part of FIG. 2.

In FIG. 1, R indicates a refiner, and the refiner R has a configuration in which a rotation shaft 2 is provided inside a main body 1.

A tapered rotor 3 having a space 3K therein is attached to the rotation shaft 2. The rotor 3 has a configuration in which a small diameter side serves as a small-diameter opening portion 1H and a large diameter side is blocked.

As shown in FIGS. 1 to 3 and FIGS. 6 to 8, a rotor beating portion 31 has a configuration in which a plurality of bars (blades) B1 is provided on a surface of the rotor 3, a groove M1 is provided between a bar (blade) B1 and a bar (blade) B1, and a plurality of through-holes H1 is provided so as to penetrate the rotor 3.

That is, a bar locking portion (not illustrated) provided in the bar B1 is locked to a bar locked portion (not illustrated) provided in the rotor beating portion 31, the bar B1 is provided across the through-hole H1, and the bar locking portion (not illustrated) locked to the bar locked portion (not illustrated) is fixed by welding or the like.

Additionally, the through-hole H1 may have a circular shape (FIGS. 2 and 3) or a rectangular shape. The shape is not limited.

Then, the bar B1 of the rotor beating portion 31 is inclined so as to guide a raw material from the small diameter side of the rotor 3 to the large diameter side of the rotor 3.

Figure 7:
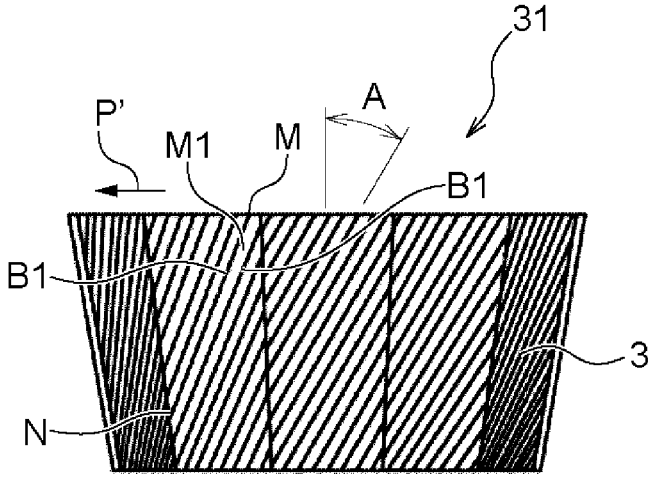
FIG. 7 is a schematic top view illustrating the rotor beating portion (the rotor) of FIG. 2.
Figure 8:
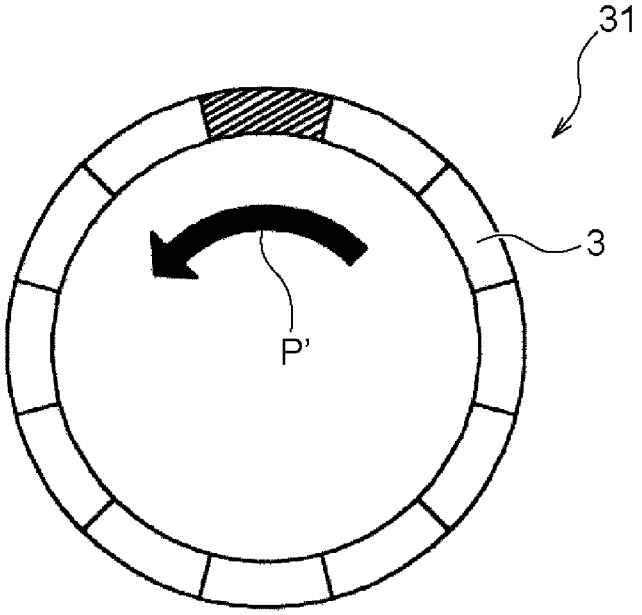
FIG. 8 is a schematic side view of FIG. 7.
Figure 9:
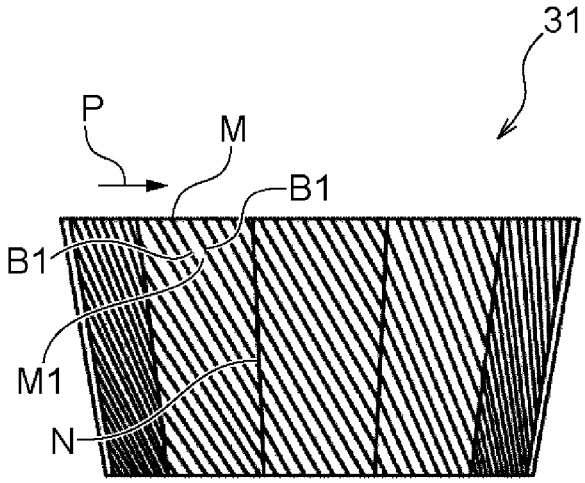
FIG. 9 is a schematic top view illustrating a rotor beating portion (rotor) of the other embodiment different from the rotor beating portion (the rotor) of FIG. 7.
Figure 10:
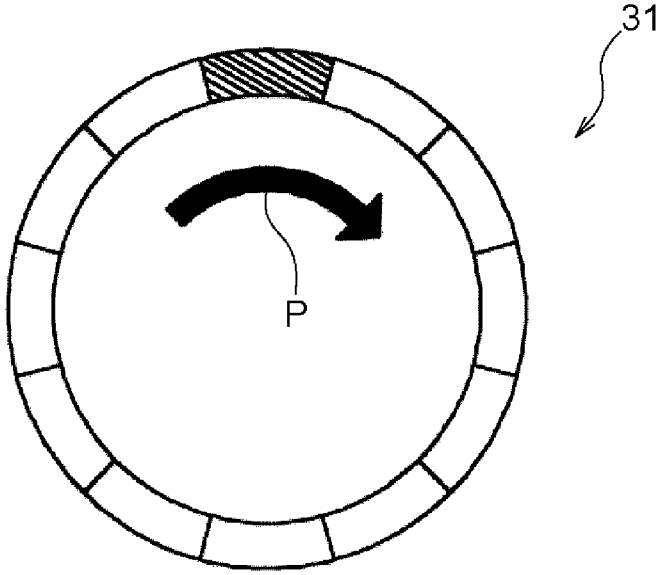
FIG. 10 is a schematic side view of FIG. 9.

That is, as illustrated in FIGS. 7 and 8, the bar B1 of the rotor beating portion 31 is inclined (an angle A of FIG. 7 is about 5° to about 30°) such that a rear end N of the bar B1 moves with respect to a front end M of the bar B1 in a rotation direction of the rotor 3 (for example, a counter-clockwise direction P' illustrated in FIG. 7 and FIG. 8) in plan view in which a deep side of the rotor beating portion 31 is positioned at a large diameter of the rotor 3 and a near side of the rotor beating portion 31 is positioned at a small diameter of the rotor 3 (see FIG. 7), and the raw material is allowed to flow from the small diameter side of the rotor 3 to the large diameter side of the rotor 3. FIG. 9 and FIG. 10 illustrate a case in which the rotation direction of the rotor 3 is set to a clockwise direction P.

In addition, a stator 4 is provided in the main body 1 to oppose the rotor 3 described above.

Figure 4:
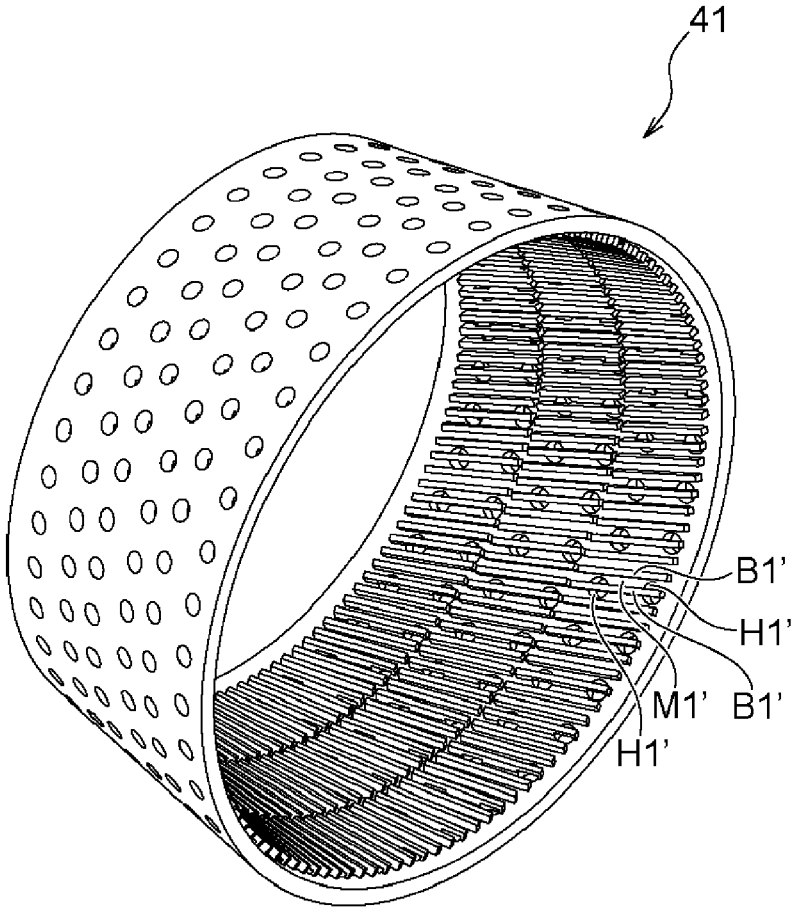
FIG. 4 is a schematic perspective view illustrating the stator beating portion (stator) of FIG. 1.
Figure 5:
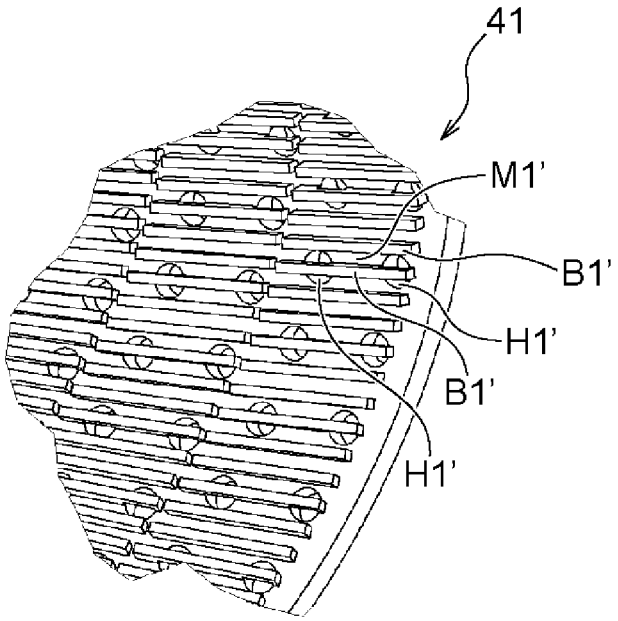
FIG. 5 is a schematic enlarged perspective view illustrating a part of FIG. 4.

As described in FIG. 1, FIG. 4, and FIG. 5, a stator beating portion 41 opposes the rotor beating portion 31, and has a plurality of bars (blades) B1' provided on a surface of the stator 4, a groove M1' provided between a bar (blade) B1' and a bar (blade) B1', and a plurality of through-holes H1' provided so as to penetrate the stator 4.

That is, a bar locking portion (not illustrated) provided in the bar B1' is locked to a bar locked portion (not illustrated) provided in the stator beating portion 41, the bar B1' is provided across the through-hole H1', and the bar locking portion (not illustrated) locked to the bar locked portion (not illustrated) is fixed by welding or the like.

Additionally, the through-hole H1' may have a circular shape (FIGS. 4 and 5) or a rectangular shape. The shape is not limited.

In this way, when the bars B1 and B1' of the beating portions of the rotor 3 and/or the stator 4 are installed across the through-holes H1 and H1', lengths of the bars B1 and B1' may be made long, and beating ability may be increased accordingly.

Reference numeral 11 illustrated in FIG. 1 denotes a raw material supply portion. The raw material supply portion 11 supplies the raw material (fibrous raw material) into the main body 1, and the raw material supply portion 11 supplies the raw material from a side of the opening portion 1H.

The raw material from the raw material supply portion 11 is configured to approach end portions X of the stator beating portion 41 and the rotor beating portion 31 on a side closed to the raw material supply portion 11, and the small-diameter opening portion 1H of the rotor.

In addition, reference numeral 5 illustrated in FIG. 1 denotes a raw material discharge portion that discharges the raw material beaten inside the main body 1 to the outside of the main body 1, and the plurality of through-holes H1' of the stator beating portion 41 and end portions Y of the stator beating portion 41 and the rotor beating portion 31 on a side far from the raw material supply portion 11 communicate with the raw material discharge portion 5.

Therefore, according to the above-described refiner R (or refiner beating method), the raw material into the main body 1 is supplied from the raw material supply portion 11.

A portion of the raw material supplied from the raw material supply portion 11 is guided into the rotor 3 through the small-diameter opening portion 1H, and another portion of the raw material is guided to between the stator beating portion 41 and the rotor beating portion 31.

Figure 6:
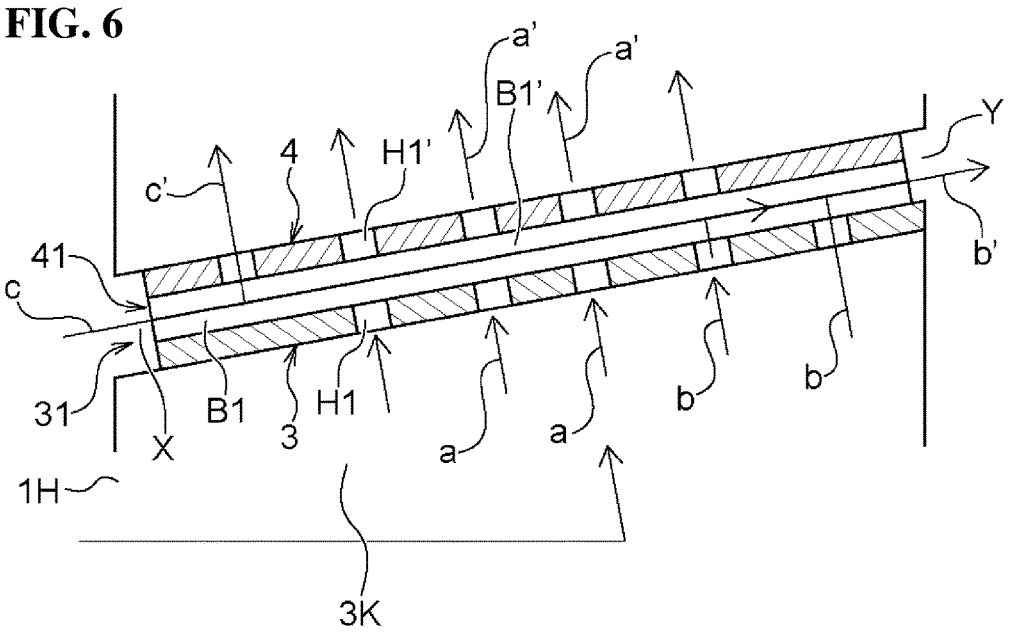
FIG. 6 is a schematic enlarged cross-sectional view illustrating a part of the beating portion of FIG. 1.

As illustrated in FIG. 6, a portion of the raw material guided to the small-diameter opening portion 1H of the rotor 3 and the space 3K of the rotor 3 are beaten by passing through the plurality of through-holes H1 of the rotor beating portion 31 and the plurality of through-holes H1' of the stator beating portion 41, and are discharged to the outside of the stator beating portion 41 from the plurality of through-holes H1' of the stator beating portion 41 (see a flow of arrows a to a' illustrated in FIG. 6)

In addition, another portion of the raw material guided to the small-diameter opening portion 1H of the rotor 3 and the space 3K of the rotor 3 passes through the plurality of through-holes H1 of the rotor beating portion 31 on a side closed to the large diameter side of the rotor 3, is beaten by passing through a gap between the stator beating portion 41 and the rotor beating portion 31, and is discharged to the outside of the stator beating portion 41 and the rotor beating portion 31 from the end portions Y of the stator beating portion 41 and the rotor beating portion 31 on the side far from the raw material supply portion 11 (see a flow of arrows b to b' illustrated in FIG. 6)

In addition, the raw material guided to between the stator beating portion 41 and the rotor beating portion 31 on the small diameter side corresponding to the end portions X on the side closed to the raw material supply portion 11 is beaten by passing through the stator beating portion 41 and the rotor beating portion 31, and is discharged to the outside of the stator beating portion 41 from the plurality of through-holes H1' of the stator beating portion 41 (see a flow of arrows c to c' illustrated in FIG. 6)

In this way, according to the above-described refiner beating method (or refiner R), the raw material beaten by passing through the plurality of through-holes H1 of the rotor beating portion 31 and the plurality of through-holes H1' of the stator beating portion 41 is discharged to the outside of the stator beating portion 41 from the plurality of through-holes H1' of the stator beating portion 41, the raw material passing through the plurality of through-holes H1 of the rotor beating portion 31 on the side close to the large diameter side of the rotor 3 and beaten by passing through a gap between the stator beating portion 41 and the rotor beating portion 31 is discharged to the outside of the stator beating portion 41 and the rotor beating portion 31 from the end portions Y of the stator beating portion 41 and the rotor beating portion 31 on the side far from the raw material supply portion 11, and the raw material guided to between the stator beating portion 41 and the rotor beating portion 31 on the small diameter side corresponding to the end portions X on the side closed to the raw material supply portion 11 is beaten by passing through the stator beating portion 41 and the rotor beating portion 31, and is discharged to the outside of the stator beating portion 41 from the plurality of through-holes H1' of the stator beating portion 41. Thus, processing capability may be increased by allowing a large amount of raw material to flow through the beating portions.

In the above-described refiner R of the embodiment illustrated in FIG. 1 to FIG. 10, when a surface area (lateral area) of the rotor 3 of the refiner R illustrated in FIG. 1 except for both ends is set to S, and a diameter of the rotor 3 on the large diameter side is set to $D_1$, and, for example, when the surface area (lateral area) of the rotor 3 illustrated in FIG. 1 except for the both ends is attempted to be increased to 2S to increase a refining zone, the diameter of the rotor 3 on the large diameter side becomes $D_2$ ($D_2>D_1$).

Figure 11:
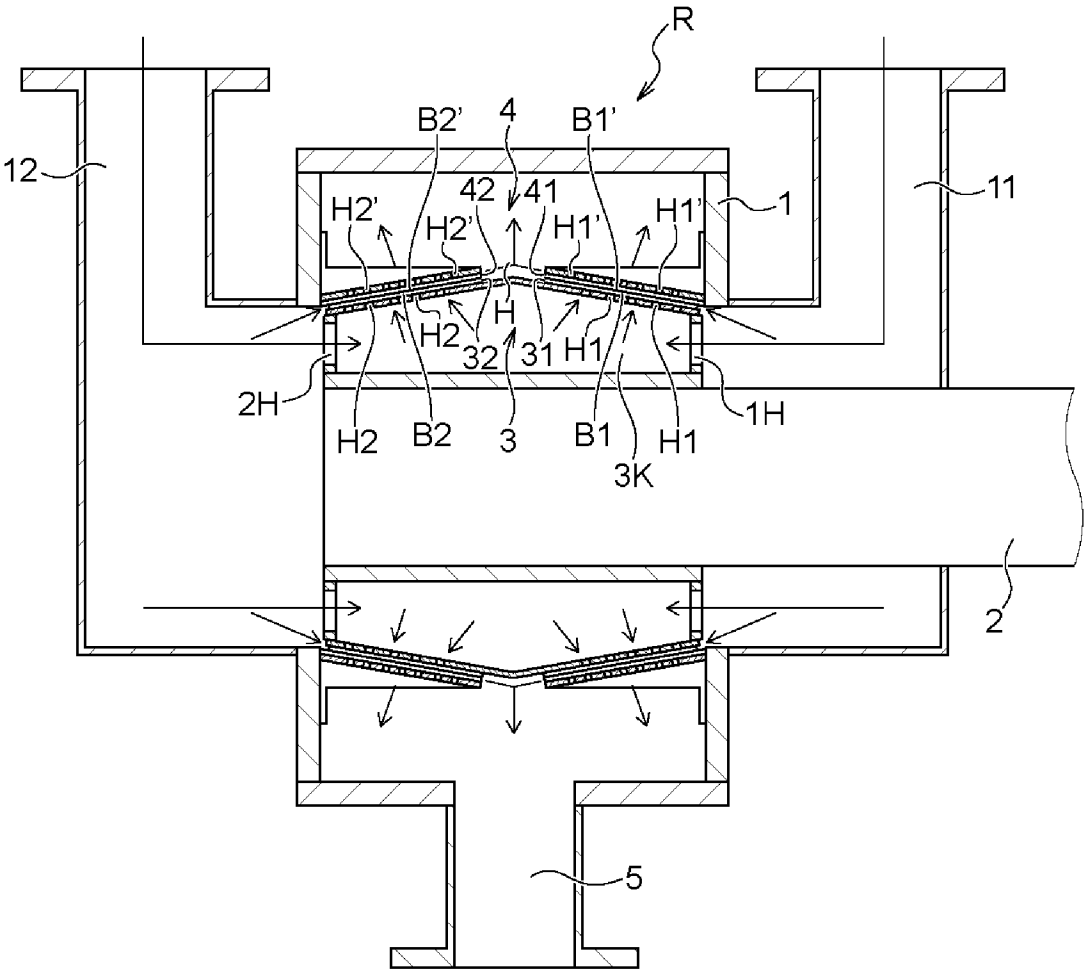
FIG. 11 is a schematic cross-sectional view illustrating a refiner of the other embodiment different from the refiner of FIG. 1.

Incidentally, if the rotor 3 of the refiner R illustrated in FIG. 1 is symmetrically provided as illustrated in FIG. 11 of an embodiment described below, even when the surface area (lateral area) of the rotor 3 except for the both ends is increased to 2S, the diameter of the rotor 3 on the large diameter side becomes $D_1$, which is the same as $D_1$ of FIG. 1.

That is, when the surface area (lateral area) of the rotor 3 except for the both ends is increased and used, if a shape illustrated in FIG. 11 is employed, the diameter may be made small to be $D_2>D_1$. Thus, there is an effect that non-load power of the refiner R may be made small, and energy conservation may be attempted.

The above-mentioned "non-load power" refers to power consumed when the rotor and the stator are open, and the rotor is rotated in pulp suspension.

Power used for actual refining is obtained by an equation of power=[power consumption of whole refiner]−[non-load power]. As non-load power decreases, total power may be more effectively used.

That is, referring to FIG. 11, R denotes a refiner. In the refiner R, a rotation shaft 2 is provided inside a main body 1.

A rotor 3 is attached to the rotation shaft 2. Here, the rotor 3 has a mountain shape in which a center is high, and includes first and second opening portions 1H and 2H, both ends of which are open. Further, a space 3K is included inside the rotor 3.

Figure 12:
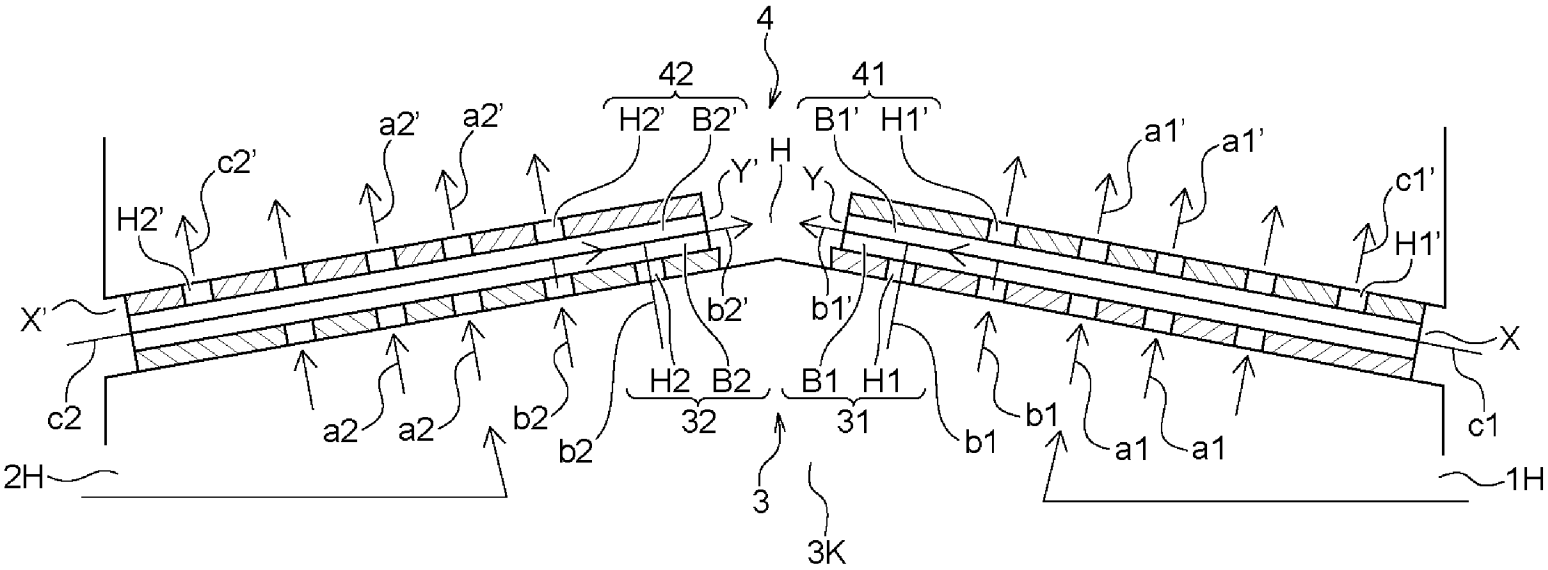
FIG. 12 is an enlarged cross-sectional view illustrating a part of a beating portion of FIG. 11.

As illustrated in FIG. 11 and FIG. 12, a rotor beating portion is provided on a surface of the rotor 3 except for a center of the rotor 3 in a longitudinal direction. The rotor beating portion has a groove between a bar (blade) and a bar (blade), and has a plurality of through-holes penetrating therethrough (see FIG. 11 to FIG. 16, the through-holes are not illustrated in FIG. 13 and FIG. 15).

As illustrated in FIG. 11 to FIG. 16, the rotor beating portion includes a first rotor beating portion 31 in which a plurality of first bars (blades) B1 is provided on a surface of the rotor 3, a first groove M1 is provided between a first bar B1 and a first bar B1, and a plurality of first through-holes H1 is provided to penetrate therethrough, and a second rotor beating portion 32 in which a plurality of second bars (blades) B2 is provided on a surface of the rotor 3, a second groove M2 is provided between a second bar B2 and a second bar B2, and a plurality of second through-holes H2 is provided to penetrate therethrough.

In addition, the first bar B1 of the first rotor beating portion 31 is inclined such that a raw material is guided from a small diameter side of the rotor 3 to a large diameter side of the rotor 3. Further, the second bar B2 of the second rotor beating portion 32 is inclined such that a raw material is guided from the small diameter side of the rotor 3 to the large diameter side of the rotor 3.

Figure 13:
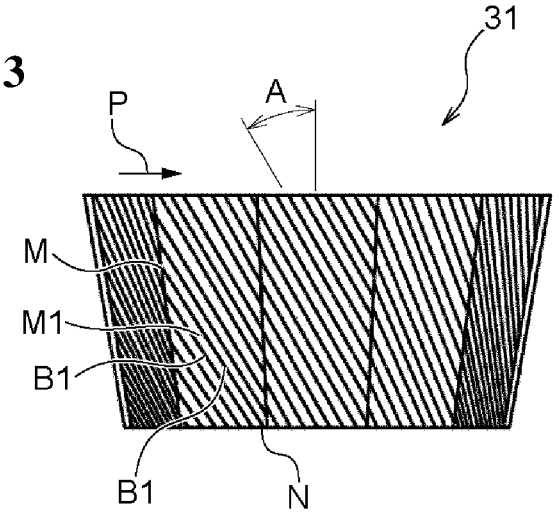
FIG. 13 is a schematic top view illustrating a first rotor beating portion (first rotor) of FIG. 11.
Figure 14:
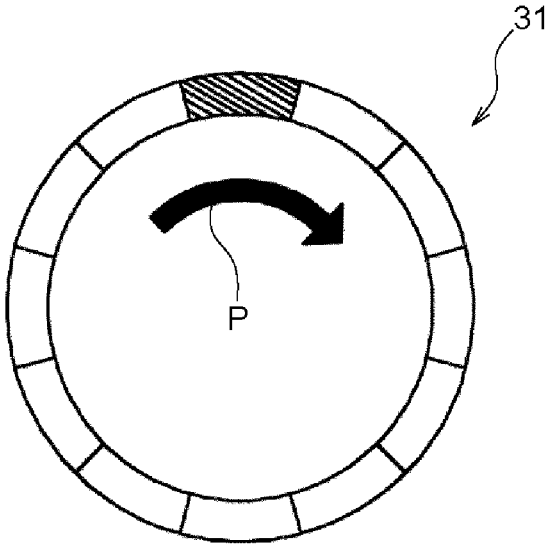
FIG. 14 is a schematic side view of FIG. 13.
Figure 17:
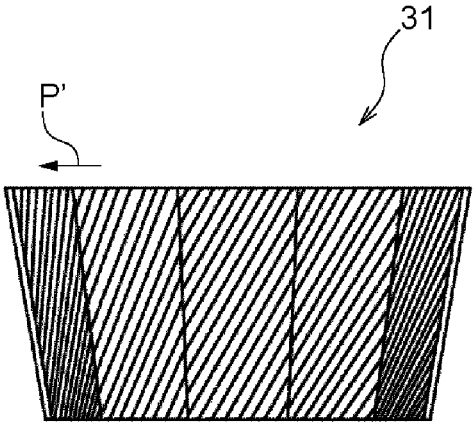
FIG. 17 is a schematic top view illustrating a first rotor beating portion (first rotor) of the other embodiment different from the first rotor beating portion (first rotor) of FIG. 13.
Figure 18:
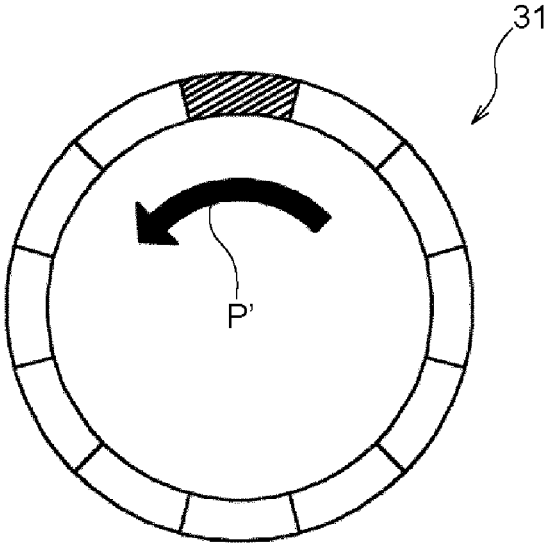
FIG. 18 is a schematic side view of FIG. 17.

That is, as illustrated in FIGS. 13 and 14, the first bar B1 of the first rotor beating portion 31 is inclined (an angle A of FIG. 13 is about 5° to about 30°) such that a rear end N of the first bar B1 moves with respect to a front end M of the first bar B1 in a rotation direction of a first rotor (for example, a clockwise direction P illustrated in FIG. 13 and FIG. 14) in plan view in which a deep side of the first rotor beating portion 31 is positioned at a large diameter of the first rotor and a near side of the first rotor beating portion 31 is positioned at a small diameter of the first rotor (see FIG. 13), and the raw material is allowed to flow from the small diameter side of the first rotor to the large diameter side of the first rotor. FIG. 17 and FIG. 18 illustrate a case in which the rotation direction of the first rotor is set to a counter-clockwise direction.

Figure 15:
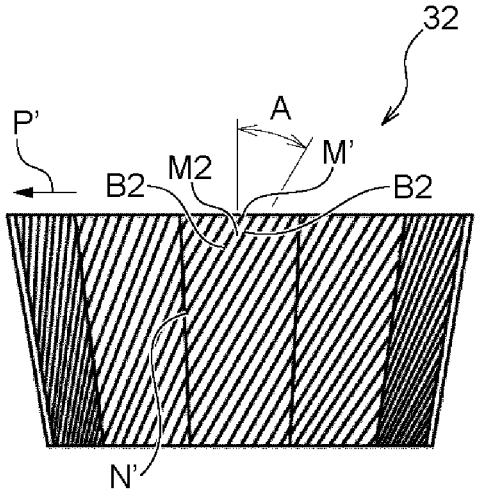
FIG. 15 is a schematic top view illustrating a second rotor beating portion (second rotor) of FIG. 11.
Figure 16:
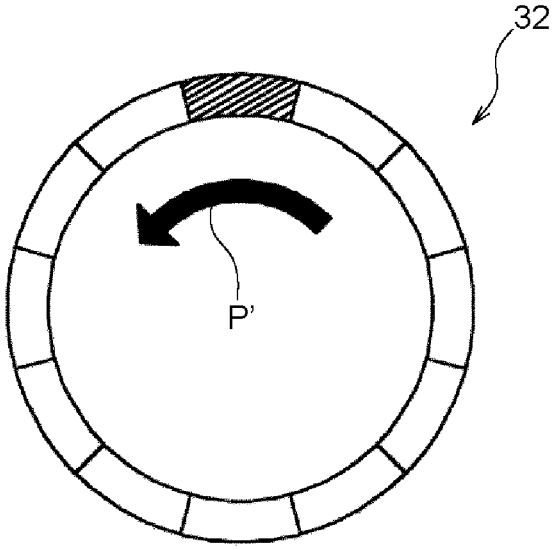
FIG. 16 is a schematic side view of FIG. 15.
Figure 19:
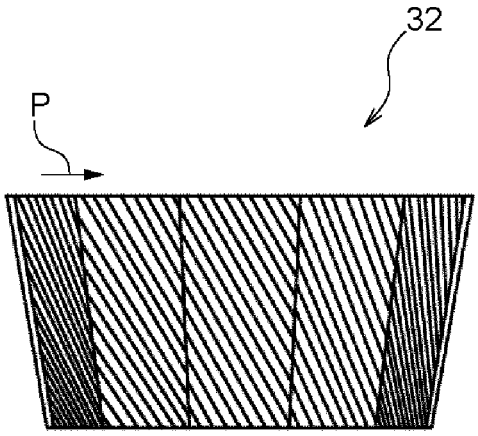
FIG. 19 is a schematic top view illustrating a second rotor beating portion (second rotor) of the other embodiment different from the second rotor beating portion (second rotor) of FIG. 15.
Figure 20:
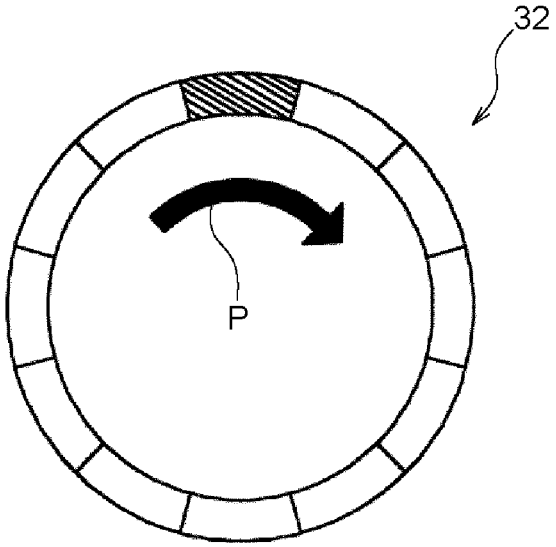
FIG. 20 is a schematic side view of FIG. 19.

In addition, as illustrated in FIGS. 15 and 16, the second bar B2 of the second rotor beating portion 32 is inclined (an angle A of FIG. 15 is about 5° to about 30°) such that a rear end N' of the second bar B2 moves with respect to a front end M' of the second bar B2 in a rotation direction of a second rotor (for example, a counterclockwise direction P' illustrated in FIG. 15 and FIG. 16) in plan view in which a deep side of the second rotor beating portion 32 is positioned at a large diameter of the second rotor and a near side of the second rotor beating portion 32 is positioned at a small diameter of the second rotor (see FIG. 15), and the raw material is allowed to flow from the small diameter side of the second rotor to the large diameter side of the second rotor. FIG. 19 and FIG. 20 illustrate a case in which the rotation direction of the second rotor is set to a clockwise direction.

Additionally, the through-holes H1 and H2 may have a circular shape or a rectangular shape (not illustrated). The shape is not limited.

In addition, a stator 4 is provided in the main body 1 to oppose the rotor 3 described above.

As described in FIG. 11 and FIG. 12, a stator beating portion opposes the rotor beating portion, is provided on a surface of the stator 4, has a groove between a bar (blade) and a bar (blade), and has a plurality of through-holes penetrating therethrough.

The stator beating portion includes a first stator beating portion 41 provided on the surface and a second stator beating portion 42 provided on the surface. Here, the first stator beating portion 41 has a first' groove (not illustrated) between a first' bar B1' and a first' bar B1', and has a plurality of first' through-holes H1' penetrating therethrough, and the second stator beating portion 42 has a second' groove (not illustrated) between a second' bar B2' and a second' bar B2', and has a plurality of second' through-holes H2' penetrating therethrough.

Additionally, the through-holes H1' and H2' may have a circular shape or a rectangular shape (not illustrated). The shape is not limited.

Reference numeral 11 illustrated in FIG. 11 denotes a first raw material supply portion. The first raw material supply portion 11 is provided in the main body 1 to supply a raw material (papermaking raw material) from a side of a first opening portion 1H. Reference numeral 12 denotes a second raw material supply portion. The second raw material supply portion 12 supplies a raw material from a side of a second opening portion 2H.

In addition, a central opening portion H is formed at a central portion of the stator beating portion, and a raw material discharge portion 5 discharges a raw material beaten inside the main body 1 to the outside of the main body 1.

In addition, the raw material from the first raw material supply portion 11 approaches end portions X of the first stator beating portion 41 and the first rotor beating portion 31 on a side close to the first raw material supply portion 11, and the first opening portion 1H. The raw material from the second raw material supply portion 12 approaches end portions X' of the second stator beating portion 42 and the second rotor beating portion 32 on a side close to the second raw material supply portion 12, and the second opening portion 2H. End portions Y of the first stator beating portion 41 and the first rotor beating portion 31 on a side far from the first raw material supply portion 11 approaches the central opening portion H. End portions Y' of the second stator beating portion 42 and the second rotor beating portion 32 on a side far from the second raw material supply portion 12 approaches the central opening portion H. The plurality of first' through-holes H1' of the first stator beating portion 41, the plurality of second' through-holes H2' of the second stator beating portion 42, and the central opening portion H communicate with the raw material discharge portion 5.

Therefore, when a raw material is supplied by the first raw material supply portion 11 and the second raw material supply portion 12, the operation proceeds as follows.

The raw material supplied from the first raw material supply portion 11 is guided from the first opening portion 1H and the end portions X of the first stator beating portion 41 and the first rotor beating portion 31 to the beating portions 31 and 41. In addition, the raw material supplied from the second raw material supply portion 12 is guided from the second opening portion 2H and the end portions X' of the second stator beating portion 42 and the second rotor beating portion 32 to the beating portions 32 and 42.

That is, a portion of a raw material guided to the first opening portion 1H of the rotor 3 and the space 3K of the rotor 3 is beaten by passing through the plurality of first through-holes H1 of the first rotor beating portion 31 and the plurality of first' through-holes H1' of the first stator beating portion 41, and is discharged to the outside of the first stator beating portion 41 from the plurality of first' through-holes H1' of the first stator beating portion 41 (see a flow of arrows a1 to a1' illustrated in FIG. 12).

In addition, a portion of a raw material guided to the second opening portion 2H of the rotor 3 and the space 3K of the rotor 3 is beaten by passing through the plurality of second through-holes H2 of the second rotor beating portion 32 and the plurality of second' through-holes H2' of the second stator beating portion 42, and is discharged to the outside of the second stator beating portion 42 from the plurality of second' through-holes H2' of the second stator beating portion 42 (see a flow of arrows a2 to a2' illustrated in FIG. 12).

In addition, a portion of a raw material guided to the first opening portion 1H of the rotor 3 and the space 3K of the rotor 3 passes through the plurality of first through-holes H1 of the first rotor beating portion 31 on a side close to the large diameter side of the first rotor, is beaten by passing through a gap between the first stator beating portion 41 and the first rotor beating portion 31, and is discharged to the outside of the first stator beating portion 41 and the first rotor beating portion 31 through the central opening portion H from the end portions Y of the first stator beating portion 41 and the first rotor beating portion 31 on the side far from the first raw material supply portion 11 (see a flow of arrows b1 to b1' illustrated in FIG. 12).

In addition, a portion of a raw material guided to the second opening portion 2H of the rotor and the space 3K of the rotor 3 passes through the plurality of second through-holes H2 of the second rotor beating portion 32 on a side close to the large diameter side of the second rotor, is beaten by passing through a gap between the second stator beating portion 42 and the second rotor beating portion 32, and is discharged to the outside of the second stator beating portion 42 and the second rotor beating portion 32 through the central opening portion H from the end portions Y' of the second stator beating portion 42 and the second rotor beating portion 32 on a side far from the second raw material supply portion 12 (see a flow of arrows b2 to b2' illustrated in FIG. 12).

In addition, a raw material guided to between the first stator beating portion 41 and the first rotor beating portion 31 on the small diameter side corresponding to the end portions X on the side close to the first raw material supply portion 11 is beaten bypassing through the first stator beating portion 41 and the first rotor beating portion 31, and is discharged to the outside of the first stator beating portion 41 from the plurality of first' through-holes H1' of the first stator beating portion 41 (see a flow of arrows c1 to c1' illustrated in FIG. 12).

In addition, a raw material guided to between the second stator beating portion 42 and the second rotor beating portion 32 on the small diameter side corresponding to the end portions X' on the side close to the second raw material supply portion 12 is beaten by passing through the second stator beating portion 42 and the second rotor beating portion 32, and is discharged to the outside of the second stator beating portion 42 from the plurality of second' through-holes H2' of the second stator beating portion 42 (see a flow of arrows c2 to c2' illustrated in FIG. 12).

In this way, according to the above-described refiner beating method (or refiner R), the raw material beaten by passing through the plurality of first through-holes H1 of the first rotor beating portion 31 and the plurality of first' through-holes H1' of the first stator beating portion 41 is discharged to the outside of the first stator beating portion 41 from the plurality of first' through-holes H1' of the first stator beating portion 41.

In addition, the raw material beaten by passing through the plurality of second through-holes H2 of the second rotor beating portion 32 and the plurality of second' through-holes H2' of the second stator beating portion 42 is discharged to the outside of the second stator beating portion 42 from the plurality of second' through-holes H2' of the second stator beating portion 42.

The raw material passing through the plurality of first through-holes H1 of the first rotor beating portion 31 on the side close to the large diameter side of the first rotor, and beaten by passing through the gap between the first stator beating portion 41 and the first rotor beating portion 31 is discharged to the outside of the first stator beating portion 41 and the first rotor beating portion 31 through the central opening portion H from the end portions Y of the first stator beating portion 41 and the first rotor beating portion 31 on the side far from the first raw material supply portion 11.

In addition, the raw material passing through the plurality of second through-holes H2 of the second rotor beating portion 32 on the side close to the large diameter side of the second rotor, and beaten by passing through the gap between the second stator beating portion 42 and the second rotor beating portion 32 is discharged to the outside of the second stator beating portion 42 and the second rotor beating portion 32 through the central opening portion H from the end portions Y' of the second stator beating portion 42 and the second rotor beating portion 32 on the side far from the second raw material supply portion 12.

In addition, the raw material guided to between the first stator beating portion 41 and the first rotor beating portion 31 on the small diameter side corresponding to the end portions X on the side close to the first raw material supply portion 11 is beaten bypassing through the first stator beating portion 41 and the first rotor beating portion 31, and is discharged to the outside of the first stator beating portion 41 from the plurality of first' through-holes H1' of the first stator beating portion 41.

In addition, the raw material guided to between the second stator beating portion 42 and the second rotor beating portion 32 on the small diameter side corresponding to the end portions X' on the side close to the second raw material supply portion 12 is beaten bypassing through the second stator beating portion 42 and the second rotor beating portion 32, and is discharged to the outside of the second stator beating portion 42 from the plurality of second' through-holes H2' of the second stator beating portion 42. Thus, an increase in processing capability may be attempted by allowing a large amount of raw material to flow through the beating portions.

The rotor 3 of the refiner R described above is not restricted to the rotor of FIG. 11. For example, a rotor of FIG. 21 may be employed.

Figure 21:
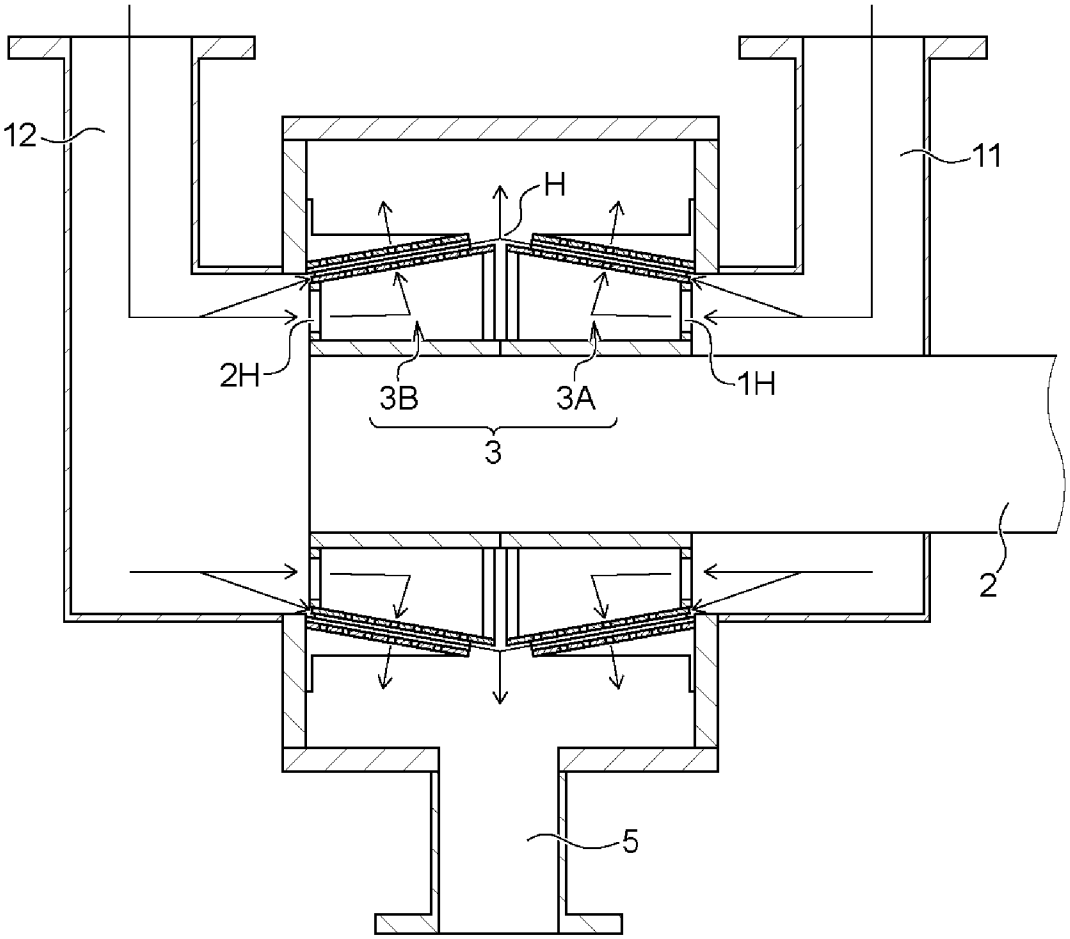
FIG. 21 is a schematic cross-sectional view illustrating a refiner of the other embodiment different from the refiner of FIG. 11.

That is, a rotor 3 illustrated in FIG. 21 corresponds to first and second tapered rotors 3A and 3B. A small diameter side of the first tapered rotor 3A corresponds to a first opening portion 1H of the rotor 3, and a large diameter side of the first tapered rotor 3A is blocked.

In addition, a small diameter side of the second tapered rotor 3B corresponds to a second opening portion 2H of the rotor 3, and a large diameter side of the second tapered rotor 3B is blocked.

Further, the large diameter side of the first tapered rotor 3A and the large diameter side of the second tapered rotor 3B oppose each other, and are attached to a rotation shaft 2.

In addition, in the refiners R of the embodiments illustrated in FIG. 11 and FIG. 21, two raw material supply portions corresponding to the first and second raw material supply portions 11 and 12 are provided as a raw material supply portion that supplies a raw material into the main body 1. However, the invention is not limited thereto. For example, as illustrated in FIG. 22, one raw material supply portion may be provided.

Figure 22:
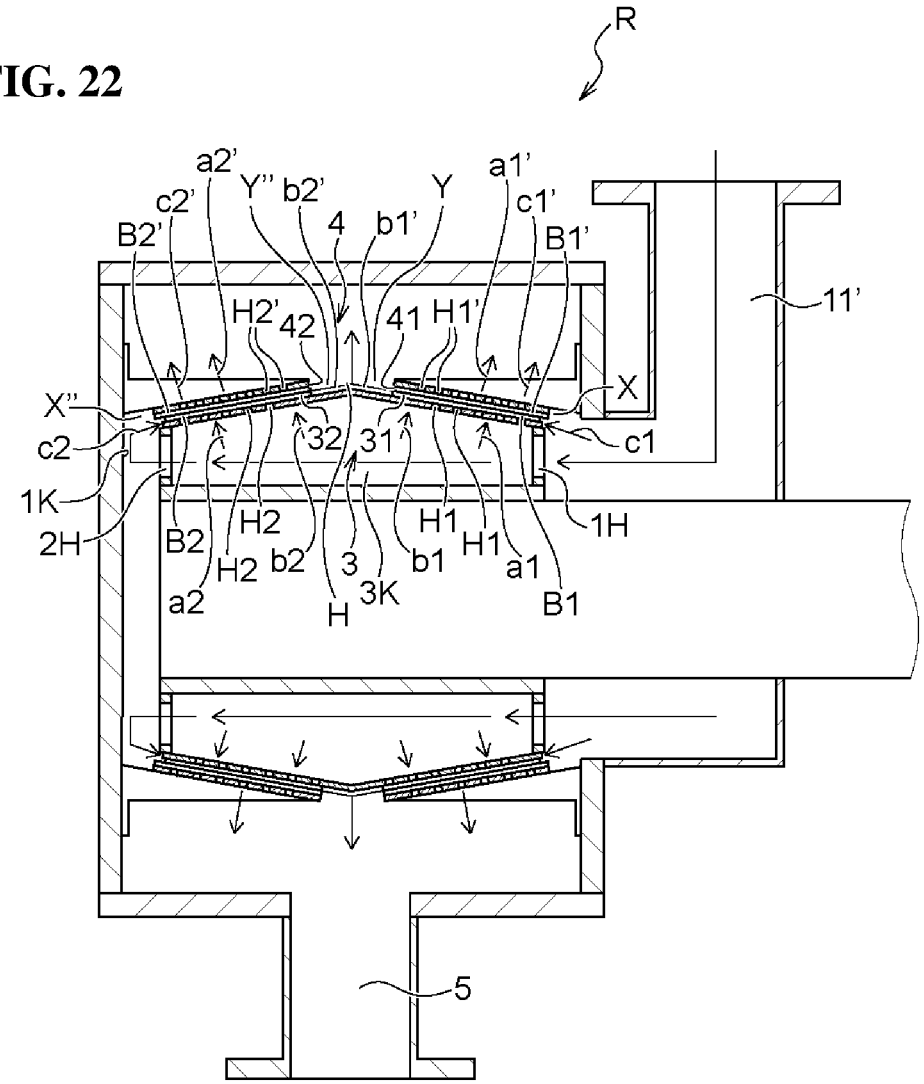
FIG. 22 is a schematic cross-sectional view illustrating a refiner of the other embodiment different from the refiner of FIG. 21.

That is, reference numeral 11' illustrated in FIG. 22 denotes a raw material supply portion. The raw material supply portion 11' is provided in a main body 1 to supply a raw material from a side of a first opening portion 1H. Here, the raw material supply portion 11' is closer to the first opening portion 1H than to a second opening portion 2H.

In addition, the second opening portion 2H opposes an inner wall 1K of the main body 1, a raw material discharged from the second opening portion 2H collides with the inner wall 1K of the main body 1 that opposes the second opening portion 2H, and the colliding raw material is guided to between a second stator beating portion 42 and a second rotor beating portion 32.

A refiner R illustrated in FIG. 22 is similar to the refiners R of the above-described embodiments illustrated in FIG. 11 to FIG. 21 except that one raw material supply portion 11' is provided, and the second opening portion 2H opposes the inner wall 1K of the main body 1. Thus, in the present embodiment, with regard to description of the refiner R illustrated in FIG. 22, FIG. 11 to FIG. 21 are quoted. In addition, the same reference numeral will be applied to the same portion of FIG. 22 as that of FIG. 11 to FIG. 21, and a part of description will be omitted.

In the refiner R illustrated in FIG. 22, a central opening portion H is formed at a central portion of a stator beating portion, a raw material from the raw material supply portion 11' approaches end portions X of a first stator beating portion 41 and a first rotor beating portion 31 on a side close to the raw material supply portion 11', and the first opening portion 1H, end portions Y of the first stator beating portion 41 and the first rotor beating portion 31 on a large diameter side face the central opening portion H, end portions Y" of the second stator beating portion 42 and the second rotor beating portion 32 on a large diameter side face the central opening portion H, and a plurality of first' through-holes H1' of the first stator beating portion 41, a plurality of second' through-holes H2' of the second stator beating portion 42, and the central opening portion H communicate with a raw material discharge portion 5.

Therefore, when a raw material is supplied from the raw material supply portion 11', the operation proceeds as follows.

A raw material supplied from the raw material supply portion 11' is guided to the beating portions 31 and 41 from the first opening portion 1H and the end portions X of the first stator beating portion 41 and the first rotor beating portion 31. In addition, a portion of a raw material guided to a space 3K of a rotor 3 is discharged from the second rotor beating portion 32 and the second opening portion 2H.

That is, a portion of a raw material guided to the first opening portion 1H of the rotor 3 and the space 3K of the rotor 3 is beaten by passing through a plurality of first through-holes H1 of the first rotor beating portion 31 and the plurality of first' through-holes H1' of the first stator beating portion 41, and is discharged to the outside of the first stator beating portion 41 from the plurality of first' through-holes H1' of the first stator beating portion 41 (see a flow of arrows a1 to a1' illustrated in FIG. 22).

In addition, a portion of a raw material guided to the space 3K of the rotor 3 is beaten by passing through a plurality of second through-holes H2 of the second rotor beating portion 32 and the plurality of second' through-holes H2' of the second stator beating portion 42, and is discharged to the outside of the second stator beating portion 42 from the plurality of second' through-holes H2' of the second stator beating portion 42 (see a flow of arrows a2 to a2' illustrated in FIG. 22).

In addition, a portion of a raw material guided to the first opening portion 1H of the rotor 3 and the space 3K of the rotor 3 passes through the plurality of first through-holes H1 of the first rotor beating portion 31 on a side close to a large diameter side of a first rotor, is beaten by passing through a gap between the first stator beating portion 41 and the first rotor beating portion 31, and is discharged to the outside of the first stator beating portion 41 and the first rotor beating portion 31 through the central opening portion H from the end portions Y of the first stator beating portion 41 and the first rotor beating portion 31 on the large diameter side (see a flow of arrows b1 to b1' illustrated in FIG. 22).

In addition, a portion of a raw material guided to the space 3K of the rotor 3 passes through the plurality of second through-holes H2 of the second rotor beating portion 32 on a side close to a large diameter side of a second rotor, is beaten by passing through a gap between the second stator beating portion 42 and the second rotor beating portion 32, and is discharged to the outside of the second stator beating portion 42 and the second rotor beating portion 32 through the central opening portion H from the end portions Y' of the second stator beating portion 42 and the second rotor beating portion 32 on the large diameter side (see a flow of arrows b2 to b2' illustrated in FIG. 22).

In addition, a raw material guided to between the first stator beating portion 41 and the first rotor beating portion 31 on a small diameter side corresponding to the end portions X on a side close to the raw material supply portion 11' is beaten by passing through the first stator beating portion 41 and the first rotor beating portion 31, and is discharged to the outside of the first stator beating portion 41 from the plurality of first' through-holes H1' of the first stator beating portion 41 (see a flow of arrows c1 to c1' illustrated in FIG. 22).

In addition, a portion of the raw material discharged from the second opening portion 2H collides with the inner wall 1K of the main body 1 that opposes the second opening portion 2H, is guided to between the second stator beating portion 42 and the second rotor beating portion 32 on the small diameter side corresponding to end portions X" on a side close to the inner wall 1K of the main body 1 that opposes the second opening portion 2H, is beaten by passing through the second stator beating portion 42 and the second rotor beating portion 32, and is discharged to the outside of the second stator beating portion 42 from the plurality of second' through-holes H2' of the second stator beating portion 42 (see a flow of arrows c2 to c2' illustrated in FIG. 22).

In this way, according to the above-described refiner beating method (or refiner R) illustrated in FIG. 22, similarly to the refiners R (or refiner beating methods) illustrated in FIG. 11 to FIG. 21, the raw material beaten by passing through the plurality of first through-holes H1 of the first rotor beating portion 31 and the plurality of first' through-holes H1' of the first stator beating portion 41 is discharged to the outside of the first stator beating portion 41 from the plurality of first' through-holes H1' of the first stator beating portion 41, the raw material beaten by passing through the plurality of second through-holes H2 of the second rotor beating portion 32 and the plurality of second' through-holes H2' of the second stator beating portion 42 is discharged to the outside of the second stator beating portion 42 from the plurality of second' through-holes H2' of the second stator beating portion 42, the raw material passing through the plurality of first through-holes H1 of the first rotor beating portion 31 on a side close to the large diameter side of the first rotor, and beaten by passing through the gap between the first stator beating portion 41 and the first rotor beating portion 31 is discharged to the outside of the first stator beating portion 41 and the first rotor beating portion 31 through the central opening portion H from the end portions Y of the first stator beating portion 41 and the first rotor beating portion 31 on a side far from the raw material supply portion 11', the raw material passing through the plurality of second through-holes H2 of the second rotor beating portion 32 on the side close to the large diameter side of the second rotor, and beaten by passing through the gap between the second stator beating portion 42 and the second rotor beating portion 32 is discharged to the outside of the second stator beating portion 42 and the second rotor beating portion 32 through the central opening portion H from the end portions Y" of the second stator beating portion 42 and the second rotor beating portion 32 on the large diameter side, the raw material guided to between the first stator beating portion 41 and the first rotor beating portion 31 on the small diameter side corresponding to the end portions X on the side close to the raw material supply portion 11' is beaten by passing through the first stator beating portion 41 and the first rotor beating portion 31, and is discharged to the outside of the first stator beating portion 41 from the plurality of first' through-holes H1' of the first stator beating portion 41, and a portion of the raw material discharged from the second opening portion 2H collides with the inner wall 1K of the main body 1 that opposes the second opening portion 2H, is guided to between the second stator beating portion 42 and the second rotor beating portion 32 on the small diameter side corresponding to the end portions X" on the side close to the inner wall 1K of the main body 1 that opposes the second opening portion 2H, is beaten by passing through the second stator beating portion 42 and the second rotor beating portion 32, and is discharged to the outside of the second stator beating portion 42 from the plurality of second' through-holes H2' of the second stator beating portion 42. Thus, an increase in processing capability may be attempted by allowing a large amount of raw material to flow through the beating portions.

In the above-describe embodiments (FIG. 11 to FIG. 22), the raw material beaten by passing between the first stator beating portion 41 and the first rotor beating portion 31 is discharged to the outside of the first stator beating portion 41 and the first rotor beating portion 31 from the central opening portion H provided at the center of the stator beating portion, and the raw material beaten by passing between the second stator beating portion 42 and the second rotor beating portion 32 is discharged to the outside of the second stator beating portion 42 and the second rotor beating portion 32 from the central opening portion H provided at the center of the stator beating portion.

However, the invention is not limited thereto. Conversely, as illustrated in FIG. 23 to FIG. 33, a portion of a raw material discharged to the outside of a first stator beating portion 41 from a first' through-hole H1' may be beaten by being guided to between the first stator beating portion 41 and a first rotor beating portion 31 from a central opening portion H provided in a part of the stator beating portion opposing a center of the rotor beating portion. In addition, a portion of a raw material discharged to the outside of a second stator beating portion 42 from a second' through-hole H2' may be beaten by being guided to between the second stator beating portion 42 and a second rotor beating portion 32 from the central opening portion H provided in the part of the stator beating portion opposing the center of the rotor beating portion. In addition, a portion of a raw material introduced to the first stator beating portion 41 and the first rotor beating portion 31 from a plurality of first through-holes H1 of the first rotor beating portion 31 on a side close to a small diameter side of a first rotor may be returned to the small diameter side of the first rotor. In addition, a portion of a raw material introduced to the second stator beating portion 42 and the second rotor beating portion 32 from a plurality of second through-holes H2 of the second rotor beating portion 32 on a side close to a small diameter side of a second rotor may be returned to the small diameter side of the second rotor. In this way, an increase in processing capability may be attempted.

Figure 23:
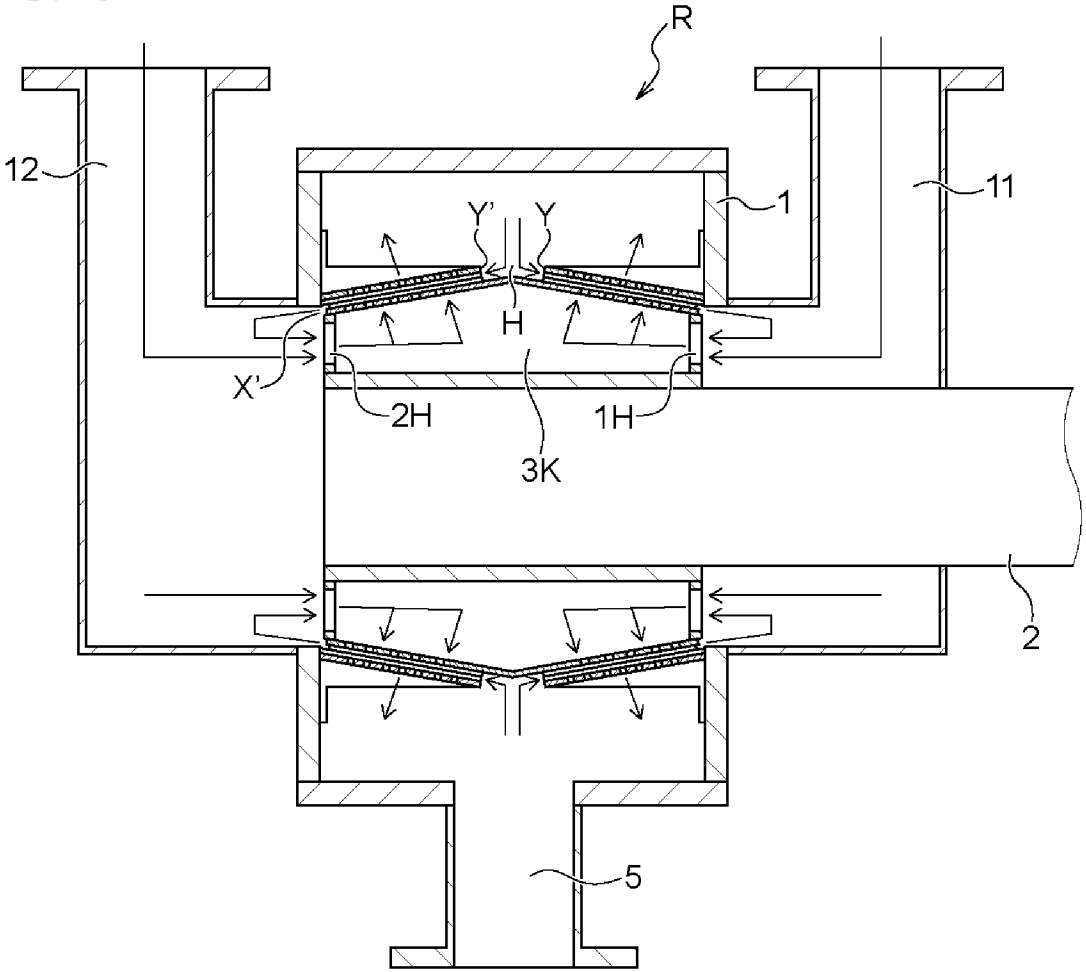
FIG. 23 is a schematic cross-sectional view illustrating a refiner of the other embodiment different from the refiner of FIG. 22.

That is, referring to FIG. 23, R denotes a refiner. In the refiner R, a rotation shaft 2 is provided inside a main body 1.

A rotor 3 is attached to the rotation shaft 2. Here, the rotor 3 has a mountain shape in which a center is high, and includes first and second opening portions 1H and 2H, both ends of which are open. Further, a space 3K is included inside the rotor 3.

Figure 24:
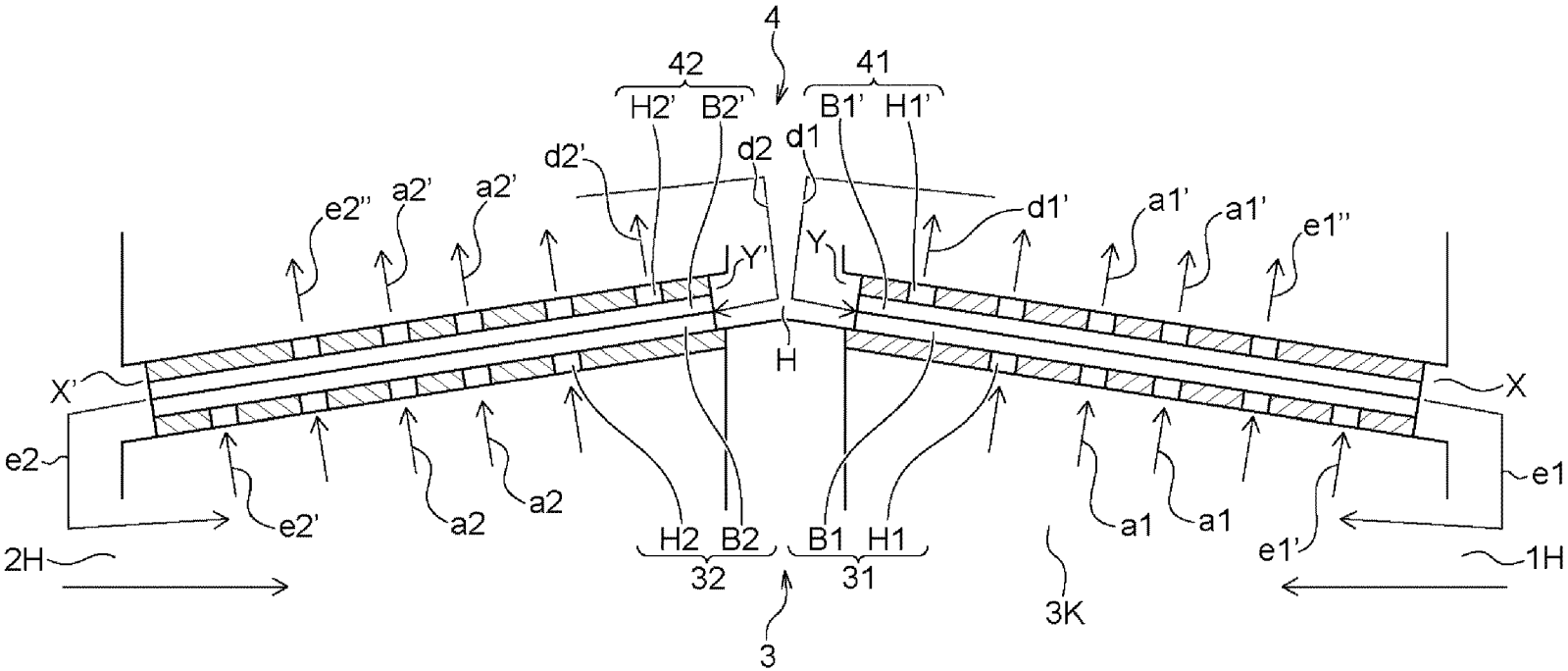
FIG. 24 is a schematic enlarged cross-sectional view illustrating a part of FIG. 23.

As illustrated in FIG. 23 and FIG. 24, the rotor beating portion is provided on a surface of the rotor 3 except for a center of the rotor 3 in a longitudinal direction. The rotor beating portion has a groove between a bar (blade) and a bar (blade), and has a plurality of through-holes penetrating therethrough (see FIG. 24 to FIG. 32, the through-holes are not illustrated in FIG. 25, FIG. 27, FIG. 29, and FIG. 31).

As illustrated in FIG. 24 and FIG. 25 to FIG. 28, the rotor beating portion includes the first rotor beating portion 31 provided on a surface of the rotor 3 and the second rotor beating portion 32 provided on a surface of the rotor 3. Here, the first rotor beating portion 31 has a first groove M1 between a first bar B1 and a first bar B1 and has a plurality of first through-holes H1 penetrating therethrough, and the second rotor beating portion 32 has a second groove M2 between a second bar B2 and a second bar B2 and has a plurality of second through-holes H2 penetrating therethrough.

In addition, the first bar B1 of the first rotor beating portion 31 is inclined such that a raw material is guided from a large diameter side of the rotor 3 to a small diameter side of the rotor 3. Further, the second bar B2 of the second rotor beating portion 32 is inclined such that a raw material is guided from the large diameter side of the rotor 3 to the small diameter side of the rotor 3.

Figure 25:
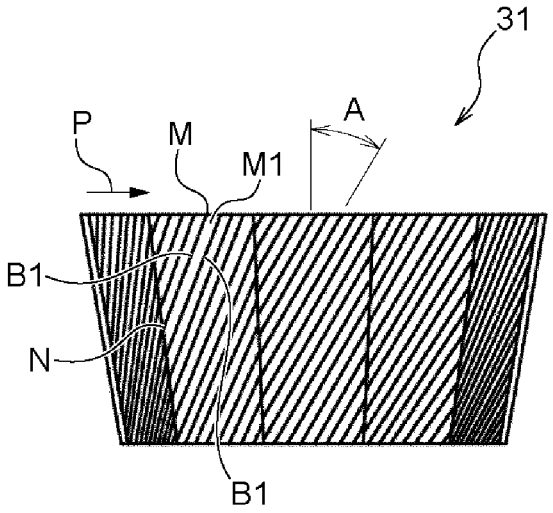
FIG. 25 is a schematic top view illustrating a first rotor beating portion (first rotor) of FIG. 24.
Figure 26:
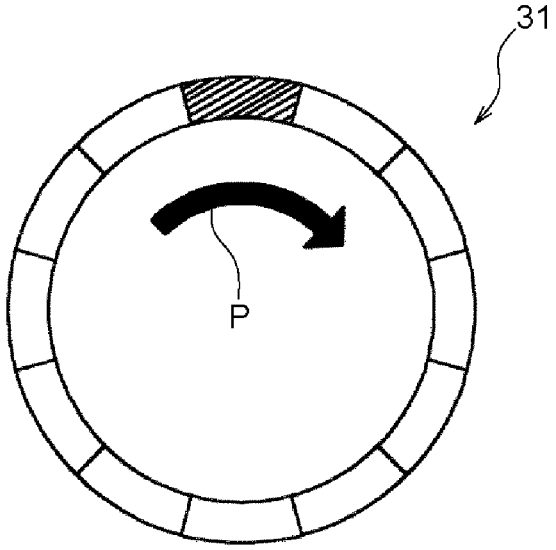
FIG. 26 is a schematic side view of FIG. 25.
Figure 29:
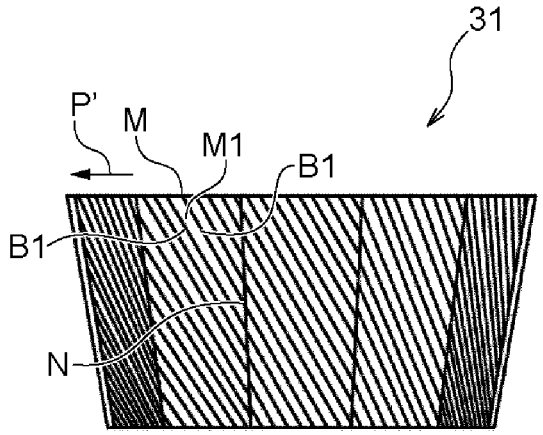
FIG. 29 is a schematic top view illustrating a first rotor beating portion (first rotor) of the other embodiment different from the first rotor beating portion (first rotor) of FIG. 25.
Figure 30:
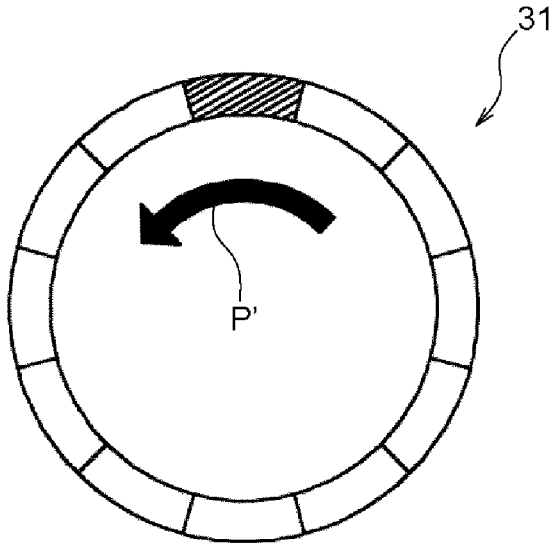
FIG. 30 is a schematic side view of FIG. 29.

That is, as illustrated in FIGS. 25 and 26, the first bar B1 of the first rotor beating portion 31 is inclined (an angle A of FIG. 25 is about 5° to about 30°) such that a front end M of the first bar B1 moves with respect to a rear end N of the first bar B1 in a rotation direction of the first rotor (for example, a clockwise direction P illustrated in FIG. 25 and FIG. 26) in plan view in which a deep side of the first rotor beating portion 31 is positioned at a large diameter of the first rotor and a near side of the first rotor beating portion 31 is positioned at a small diameter of the first rotor (see FIG. 25), and the raw material is allowed to flow from the large diameter side of the first rotor to the small diameter side of the first rotor. FIG. 29 and FIG. 30 illustrate a case in which the rotation direction of the first rotor is set to a counterclockwise direction P'.

Figure 27:
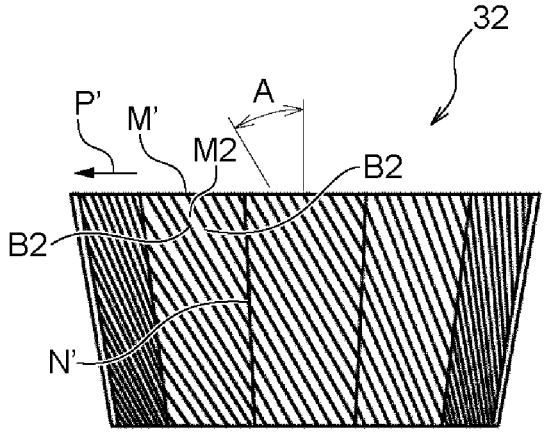
FIG. 27 is a schematic top view illustrating a second rotor beating portion (second rotor) of FIG. 21.
Figure 28:
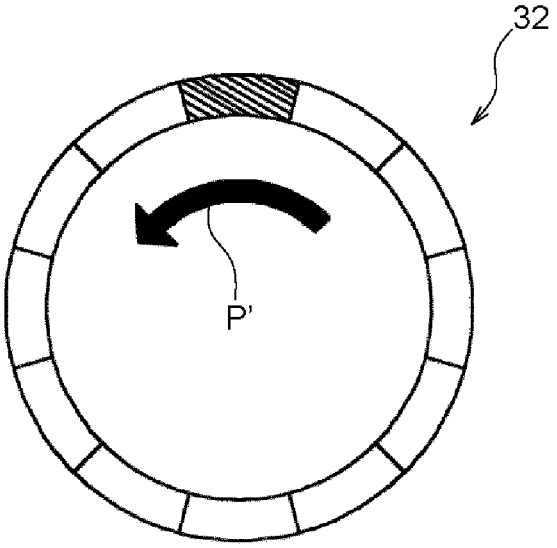
FIG. 28 is a schematic side view of FIG. 27.
Figure 31:
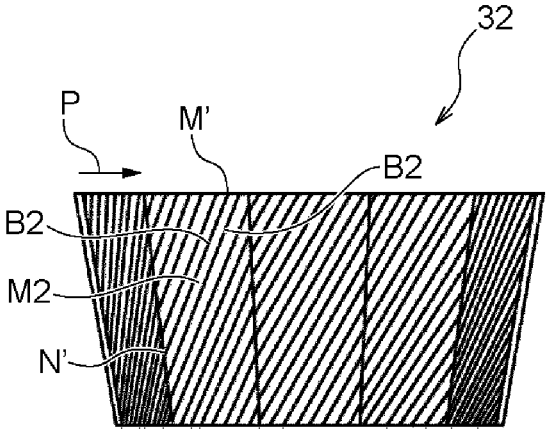
FIG. 31 is a schematic top view illustrating a second rotor beating portion (second rotor) of the other embodiment different from the second rotor beating portion (second rotor) of FIG. 27.
Figure 32:
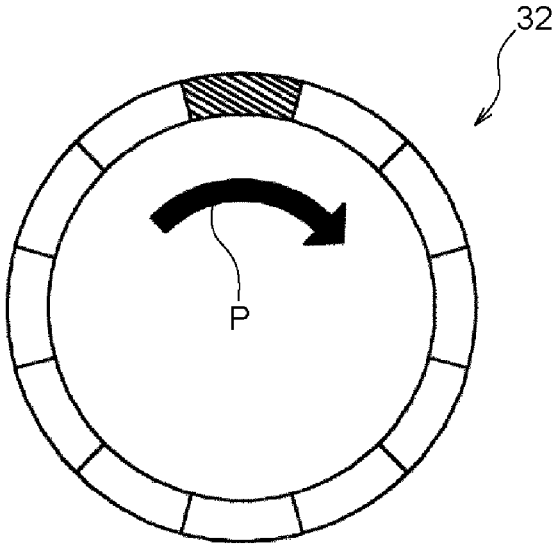
FIG. 32 is a schematic side view of FIG. 31.

In addition, as illustrated in FIGS. 27 and 28, the second bar B2 of the second rotor beating portion 32 is inclined (an angle A of FIG. 27 is about 5° to about 30°) such that a front end M' of the second bar B2 moves with respect to a rear end N' of the second bar B2 in a rotation direction of the second rotor (for example, a counterclockwise direction P' illustrated in FIG. 27 and FIG. 28) in plan view in which a deep side of the second rotor beating portion 32 is positioned at a large diameter of the second rotor and a near side of the second rotor beating portion 32 is positioned at a small diameter of the second rotor (see FIG. 27), and the raw material is allowed to flow from the large diameter side of the second rotor to the small diameter side of the second rotor. FIG. 31 and FIG. 32 illustrate a case in which the rotation direction of the second rotor is set to a clockwise direction P.

Additionally, the through-holes H1 and H2 may have a circular shape or a rectangular shape (not illustrated). The shape is not limited.

In addition, a stator 4 is provided in the main body 1 to oppose the rotor 3 described above.

As described in FIG. 23 and FIG. 24, the stator beating portion opposes the rotor beating portion, is provided on a surface of the stator 4, has a groove between a bar (blade) and a bar (blade), and has a plurality of through-holes penetrating therethrough.

The stator beating portion includes a first stator beating portion 41 provided on the surface and a second stator beating portion 42 provided on the surface. Here, the first stator beating portion 41 has a first' groove (not illustrated) between a first' bar B1' and a first' bar B1 ‘, and has a plurality of first’ through-holes H1' penetrating therethrough, and the second stator beating portion 42 has a second' groove (not illustrated) between a second' bar B2' and a second' bar B2', and has a plurality of second' through-holes H2' penetrating therethrough.

Additionally, the through-holes H1' and H2' may have a circular shape or a rectangular shape (not illustrated). The shape is not limited.

Reference numeral 11 illustrated in FIG. 23 denotes a first raw material supply portion. The first raw material supply portion 11 is provided in the main body 1 to supply a raw material (papermaking raw material) from a side of a first opening portion 1H. Reference numeral 12 denotes a second raw material supply portion. The second raw material supply portion 12 supplies a raw material from a side of a second opening portion 2H.

In addition, a central opening portion H is formed at a central portion of the stator beating portion, and a raw material discharge portion 5 discharges a raw material beaten inside the main body 1 to the outside of the main body 1.

In addition, end portions Y of the first stator beating portion 41 and the first rotor beating portion 31 on a side far from the first raw material supply portion 11 face the central opening portion H, end portions Y' of the second stator beating portion 42 and the second rotor beating portion 32 on a side far from the second raw material supply portion 12 face the central opening portion H, the raw material from the first raw material supply portion 11 approaches the first opening portion 1H and end portions X of the first stator beating portion 41 and the first rotor beating portion 31 on a side close to the first raw material supply portion 11, and the raw material from the second raw material supply portion 12 approaches the second opening portion 2H and end portions X' of the second stator beating portion 42 and the second rotor beating portion 32 on a side close to the second raw material supply portion 12. Further, the plurality of first' through-holes H1' of the first stator beating portion 41, the plurality of second' through-holes H2' of the second stator beating portion 42, and the central opening portion H communicate with the raw material discharge portion 5.

Therefore, when a raw material is supplied by the first raw material supply portion 11 and the second raw material supply portion 12, the operation proceeds as follows.

A portion of the raw material supplied from the first raw material supply portion 11 is beaten by passing through the first opening portion 1H, the space 3K of the rotor 3, the plurality of first through-holes H1 of the first rotor beating portion 31, and the plurality of first' through-holes H1' of the first stator beating portion 41, and is discharged to the outside of the first stator beating portion 41 from the plurality of first' through-holes H1' of the first stator beating portion 41 (see a flow of arrows a1 to a1' illustrated in FIG. 24).

In addition, a portion of the raw material supplied from the second raw material supply portion 12 is beaten by passing through the second opening portion 2H, the space 3K of the rotor 3, the plurality of second through-holes H2 of the second rotor beating portion 32, and the plurality of second' through-holes H2' of the second stator beating portion 42, and is discharged to the outside of the second stator beating portion 42 from the plurality of second' through-holes H2' of the second stator beating portion 42 (see a flow of arrows a2 to a2' illustrated in FIG. 24).

In addition, a portion of the raw material discharged to the outside of the first stator beating portion 41 from the plurality of first' through-holes H1' of the first stator beating portion 41 is beaten by being guided to between the first stator beating portion 41 and the first rotor beating portion 31 from the end portions Y of the first stator beating portion 41 and the first rotor beating portion 31 on the side far from the first raw material supply portion 11 through the central opening portion H, and is discharged to the outside of the first stator beating portion 41 from the plurality of first' through-holes H1' of the first stator beating portion 41 on a side close to the large diameter side of the first rotor (see a flow of arrows d1 to d1' illustrated in FIG. 24).

In addition, a portion of the raw material discharged to the outside of the second stator beating portion 42 from the plurality of second' through-holes H2' of the second stator beating portion 42 is beaten by being guided to between the second stator beating portion 42 and the second rotor beating portion 32 from the end portions Y' of the second stator beating portion 42 and the second rotor beating portion 32 on a side far from the second raw material supply portion 12 through the central opening portion H, and is discharged to the outside of the second stator beating portion 42 from the plurality of second' through-holes H2' of the second stator beating portion 42 on a side close to the large diameter side of the second rotor (see a flow of arrows d2 to d2' illustrated in FIG. 24).

In addition, the portion of the raw material introduced to the first stator beating portion 41 and the first rotor beating portion 31 from the plurality of first through-holes H1 of the first rotor beating portion 31 on the side close to the small diameter side of a first rotor is returned to the small diameter side of the first rotor, is discharged from the end portions X of the first stator beating portion 41 and the first rotor beating portion 31 on the side close to the first raw material supply portion 11, joins the raw material supplied from the first raw material supply portion 11, is beaten by passing through the first opening portion 1H of the rotor 3, the space 3K of the rotor 3, the plurality of first through-holes H1 of the first rotor beating portion 31, and the plurality of first' through-holes H1' of the first stator beating portion 41, and is discharged to the outside of the first stator beating portion 41 from the plurality of first' through-holes H1' of the first stator beating portion 41 (see a flow of arrows e1 to e1' to e1" illustrated in FIG. 24).

In addition, the portion of the raw material introduced to the second stator beating portion 42 and the second rotor beating portion 32 from the plurality of second through-holes H2 of the second rotor beating portion 32 on the side close to the small diameter side of the second rotor is returned to the small diameter side of the second rotor, is discharged from the end portions X' of the second stator beating portion 42 and the second rotor beating portion 32 on the side close to the second raw material supply portion 12, joins the raw material supplied from the second raw material supply portion 12, is beaten by passing through the second opening portion 2H of the rotor 3, the space 3K of the rotor 3, the plurality of second through-holes H2 of the second rotor beating portion 32, and the plurality of second' through-holes H2' of the second stator beating portion 42, and is discharged to the outside of the second stator beating portion 42 from the plurality of second' through-holes H2' of the second stator beating portion 42 (see a flow of arrows e2 to e2' to e2" illustrated in FIG. 24).

In this way, according to the above-described refiner beating method (or refiner R), the raw material is discharged to the outside of the first stator beating portion 41 from the plurality of first' through-holes H1' of the first stator beating portion 41, the raw material is discharged to the outside of the second stator beating portion 42 from the plurality of second' through-holes H2' of the second stator beating portion 42, the portion of the raw material discharged to the outside of the first stator beating portion 41 is beaten by being guided to between the first stator beating portion 41 and the first rotor beating portion 31 from the end portions Y of the first stator beating portion 41 and the first rotor beating portion 31 on the side far from the first raw material supply portion 11 through the central opening portion H, and is discharged to the outside of the first stator beating portion 41 from the plurality of first' through-holes H1' of the first stator beating portion 41 on the side close to the large diameter side of the first rotor, the portion of the raw material discharged to the outside of the second stator beating portion 42 is beaten by being guided to between the second stator beating portion 42 and the second rotor beating portion 32 from the end portions Y' of the second stator beating portion 42 and the second rotor beating portion 32 on the side far from the second raw material supply portion 12 through the central opening portion H, and is discharged to the outside of the second stator beating portion 42 from the plurality of second' through-holes H2' of the second stator beating portion 42 on the side close to the large diameter side of the second rotor, the portion of the raw material introduced to the first stator beating portion 41 and the first rotor beating portion 31 from the plurality of first through-holes H1 of the first rotor beating portion 31 on the side close to the small diameter side of the first rotor is returned from the end portions X of the first stator beating portion 41 and the first rotor beating portion 31 on the side close to the first raw material supply portion 11, joins the raw material supplied from the first raw material supply portion 11, is beaten by passing through the first opening portion 1H of the first rotor, the space 3K of the rotor 3, the plurality of first through-holes H1 of the first rotor beating portion 31, and the plurality of first' through-holes H1' of the first stator beating portion 41, and is discharged to the outside of the first stator beating portion 41 from the plurality of first' through-holes H1' of the first stator beating portion 41, and the portion of the raw material introduced to the second stator beating portion 42 and the second rotor beating portion 32 from the plurality of second through-holes H2 of the second rotor beating portion 32 on the side close to the small diameter side of the second rotor is returned from the end portions X' of the second stator beating portion 42 and the second rotor beating portion 32 on the side close to the second raw material supply portion 12, joins the raw material supplied from the second raw material supply portion 12, is beaten by passing through the second opening portion 2H of the rotor 3, the space 3K of the rotor 3, the plurality of second through-holes H2 of the second rotor beating portion 32, and the plurality of second' through-holes H2' of the second stator beating portion 42, and is discharged to the outside of the second stator beating portion 42 from the plurality of second' through-holes H2' of the second stator beating portion 42. Thus, processing capability may be increased by allowing a large amount of raw material to flow through the beating portions.

The rotor 3 of the refiner R illustrated in FIG. 23 has a mountain shape in which a center is high, includes the first and second opening portions 1H and 2H, both ends of which are open, and has the space 3K therein. However, the invention is not limited thereto. For example, it is possible to employ "a rotor 3 configured such that a large diameter side of a first tapered rotor 3A opposes a large diameter side of a second tapered rotor 3B" illustrated in FIG. 33.

Figure 33:
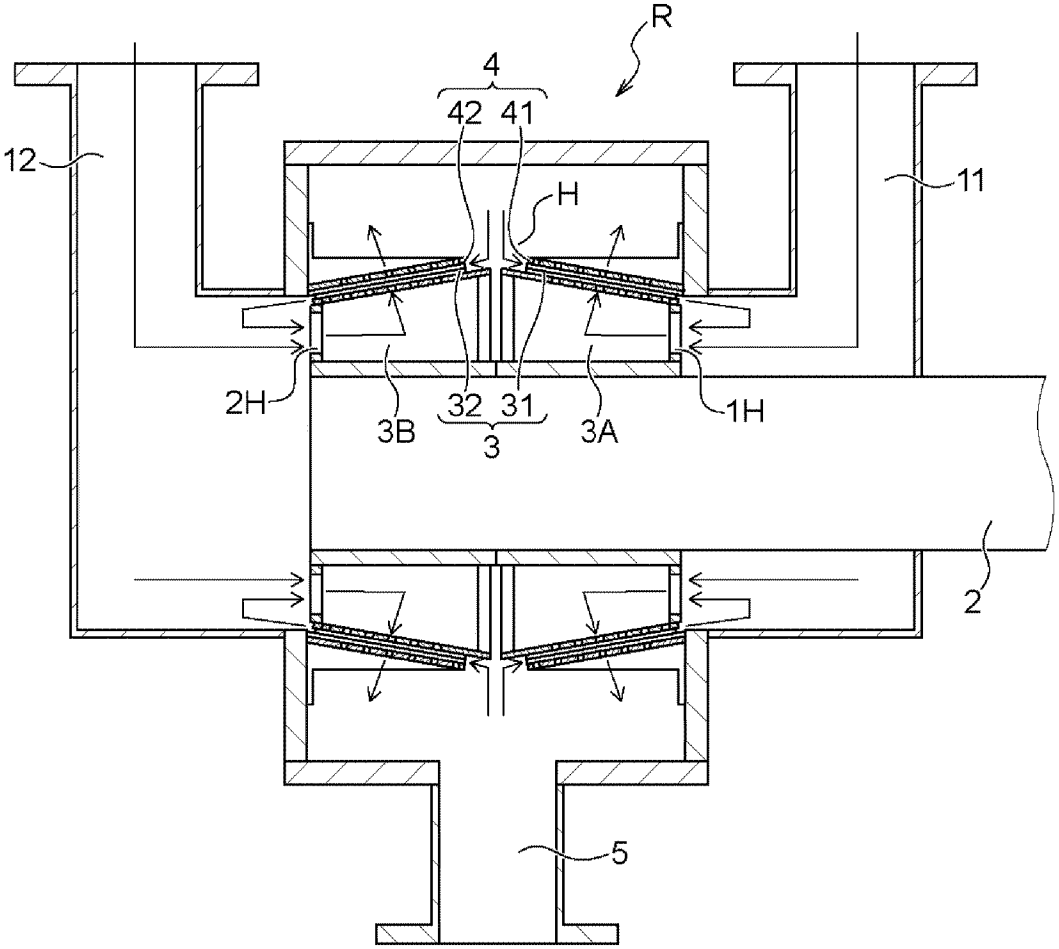
FIG. 33 is a schematic cross-sectional view illustrating a refiner of the other embodiment different from the refiner of FIG. 23.

In addition, the rotor 3 of the refiner R of the above-described embodiments illustrated in FIG. 23 and FIG. 33 has a mountain shape in which a center is high. However, the rotor 3 of the refiner R of the invention is not limited thereto. For example, a rotor 3 of a refiner R illustrated in FIG. 34 may be employed.

That is, in the refiner R, a rotation shaft 2 is provided inside a main body 1.

A tapered rotor 3 having a space 3K therein is attached to the rotation shaft 2.

The rotor 3 has a configuration in which a small diameter side serves as a small-diameter opening portion 1H and a large diameter side is blocked.

Figure 35:
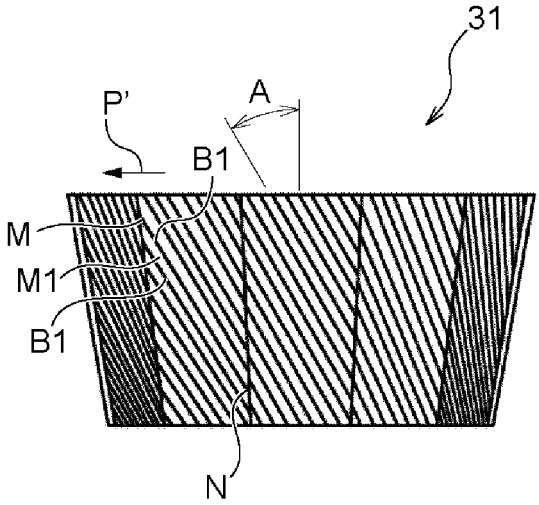
FIG. 35 is a schematic top view illustrating a rotor beating portion (rotor) of FIG. 34.
Figure 36:
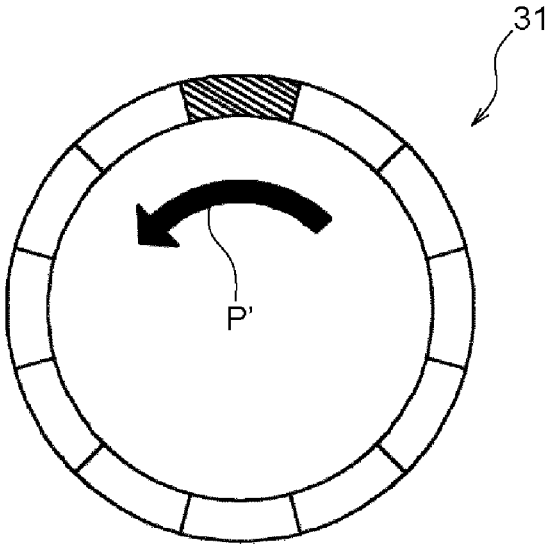
FIG. 36 is a schematic side view of FIG. 35.

As illustrated in FIG. 35 and FIG. 36, a rotor beating portion 31 is provided on a surface of the rotor 3. In addition, the rotor beating portion 31 has a groove M1 between a bar (blade) B1 and a bar (blade) B1, and has a plurality of through-holes H1 penetrating therethrough.

Further, the bar B1 of the rotor beating portion 31 is inclined such that a raw material is guided from the large diameter side of the rotor 3 to the small diameter side of the rotor 3.

Figure 37:
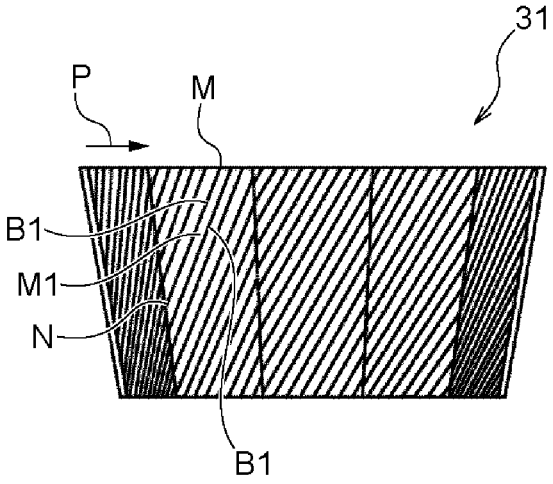
FIG. 37 is a schematic top view illustrating a rotor beating portion (rotor) of the other embodiment different from the rotor beating portion (rotor) of FIG. 35.
Figure 38:
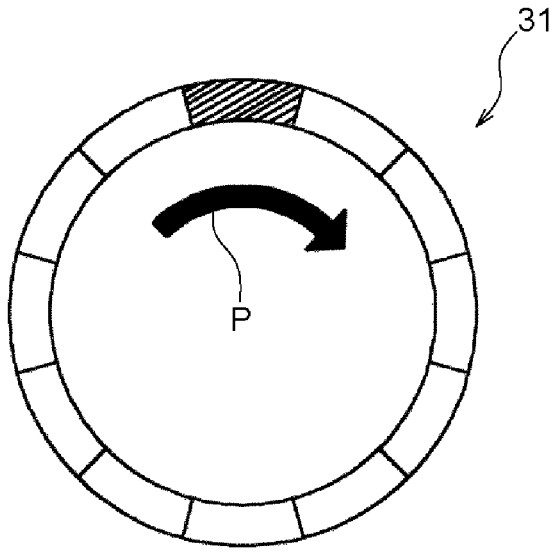
FIG. 38 is a schematic side view of FIG. 37.

That is, as illustrated in FIG. 35 and FIG. 36, the bar B1 of the rotor beating portion 31 is inclined (an angle A of FIG. 35 is about 5° to about 30°) such that a front end M of the bar B1 moves with respect to a rear end N of the bar B1 in a rotation direction of the rotor 3 (for example, a counter-clockwise direction P' illustrated in FIG. 35 and FIG. 36) in plan view in which a deep side of the rotor beating portion 31 is positioned at a large diameter of the rotor 3 and a near side of the rotor beating portion 31 is positioned at a small diameter of the rotor 3 (see FIG. 35), and the raw material is allowed to flow from the large diameter side of the rotor 3 to the small diameter side of the rotor 3. FIG. 37 and FIG. 38 illustrate a case in which the rotation direction of the rotor 3 is set to a clockwise direction P.

In addition, a stator 4 is provided in the main body 1 to oppose the above-described rotor 3.

Figure 34:
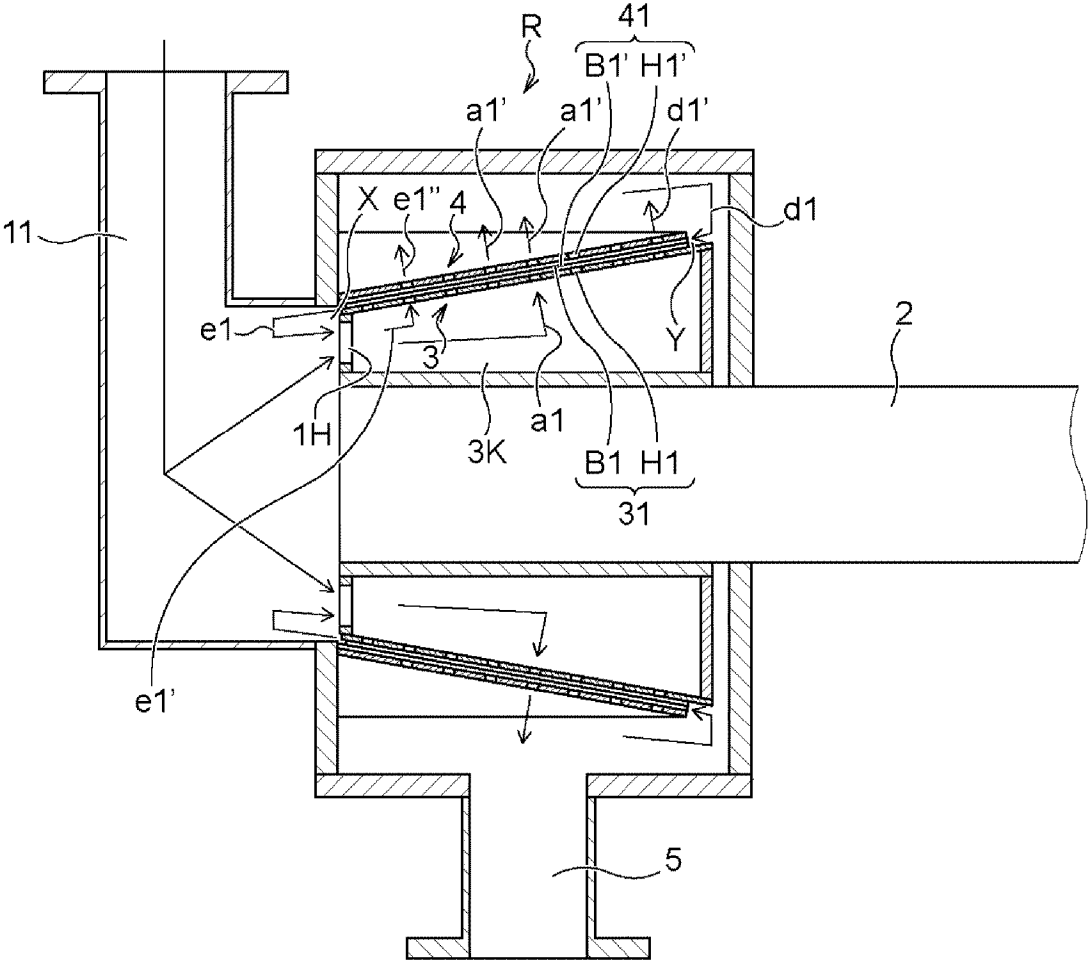
FIG. 34 is a schematic cross-sectional view illustrating a refiner of the other embodiment different from the refiner of FIG. 33.

As described in FIG. 34, a stator beating portion 41 opposes the rotor beating portion 31, is provided on a surface of the stator 4, has a groove (not illustrated) between a bar (blade) B1' and a bar (blade) B1', and has a plurality of through-holes H1' penetrating therethrough.

Reference numeral 11 illustrated in FIG. 34 denotes a raw material supply portion. The raw material supply portion 11 supplies the raw material (fibrous raw material) into the main body 1, and the raw material supply portion 11 supplies the raw material from a side of the opening portion 1H. Reference numeral 5 denotes a raw material discharge portion that discharges a beaten raw material to the outside of the main body 1.

Further, the raw material from the raw material supply portion 11 approaches end portions X of the stator beating portion 41 and the rotor beating portion 31 on a side closed to the raw material supply portion 11, and the small-diameter opening portion 1H of the rotor 3. In addition, the plurality of through-holes H1' of the stator beating portion 41 and end portions Y of the stator beating portion 41 and the rotor beating portion 31 on a side far from the raw material supply portion 11 communicate with the raw material discharge portion 5.

Therefore, when a raw material is supplied from the raw material supply portion 11, the raw material from the raw material supply portion 11 is guided to the small-diameter opening portion 1H of the rotor 3.

A raw material beaten by passing through the small-diameter opening portion 1H of the rotor 3, the space 3K of the rotor 3, the plurality of through-holes H1 of the rotor beating portion 31, and the plurality of through-holes H1' of the stator beating portion 41 is discharged to the outside of the stator beating portion 41 from the plurality of through-holes H1' of the stator beating portion 41 (see a flow of arrows a1 to a1' illustrated in FIG. 34).

In addition, a portion of the material discharged to the outside of the stator beating portion 41 from the through-holes H1' of the stator beating portion 41 is beaten by being guided to between the stator beating portion 41 and the rotor beating portion 31 from the end portions Y of the stator beating portion 41 and the rotor beating portion 31 on the side far from the raw material supply portion 11, and is discharged to the outside of the stator beating portion 41 from the plurality of through-holes H1' of the stator beating portion 41 on a side close to the large diameter side of the rotor 3 (see a flow of arrows d1 to d1' illustrated in FIG. 34).

In addition, a portion of a raw material introduced to the stator beating portion 41 and the rotor beating portion 31 from the plurality of through-holes H1 of the rotor beating portion 31 on a side close to the small diameter side of the rotor 3 is returned to the small diameter side of the rotor 3, is discharged from the end portions X of the stator beating portion 41 and the rotor beating portion 31 on a side close to the raw material supply portion 11, joins the raw material supplied from the raw material supply portion 11, is beaten bypassing through the small-diameter opening portion 1H of the rotor 3, the space 3K of the rotor 3, the plurality of through-holes H1 of the rotor beating portion 31, and the plurality of through-holes H1' of the stator beating portion 41, and is discharged to the outside of the stator beating portion 41 from the plurality of through-holes H1' of the stator beating portion 41 (see a flow of arrows e1 to e1' to e" illustrated in FIG. 34).

In this way, according to the above-described refiner beating method (or refiner R) illustrated in FIGS. 34 to 38, similarly to the refiners R (or refiner beating methods) illustrated in FIG. 23 to FIG. 33, the raw material is discharged to the outside of the stator beating portion 41 from the plurality of through-holes H1' of the stator beating portion 41, the portion of the material discharged to the outside of the stator beating portion 41 is beaten by being guided to between the stator beating portion 41 and the rotor beating portion 31 from the end portions Y of the stator beating portion 41 and the rotor beating portion 31 on the side far from the raw material supply portion 11, and is discharged to the outside of the stator beating portion 41 from the plurality of through-holes H1' of the stator beating portion 41 on the side close to the large diameter side of the rotor 3, and the portion of the raw material introduced to the stator beating portion 41 and the rotor beating portion 31 from the plurality of through-holes H1 of the rotor beating portion 31 on the side close to the small diameter side of the rotor 3 is returned from the end portions X of the stator beating portion 41 and the rotor beating portion 31 on the side close to the raw material supply portion 11, joins the raw material supplied from the raw material supply portion 11, is beaten bypassing through the small-diameter opening portion 1H of the rotor 3, the space 3K of the rotor 3, the plurality of through-holes H1 of the rotor beating portion 31, and the plurality of through-holes H1' of the stator beating portion 41, and is discharged to the outside of the stator beating portion 41 from the plurality of through-holes H1' of the stator beating portion 41. Thus, an increase in processing capability may be attempted by allowing a large amount of raw material to flow through the beating portions.

The present invention claims the priority of Japanese patent application No. 2015-117405 filed on Jun. 10, 2015, the disclosure of which is incorporated herein.

REFERENCE SIGNS LIST

R refiner
Y end portions on far side
1 main body
2 rotation shaft
3 rotor
4 stator
11 raw material supply portion (first raw material supply portion)
12 second raw material supply portion
31 first rotor beating portion
32 second rotor beating portion
41 first stator beating portion
42 second stator beating portion
H1' first' through-holes
H2' second' through-holes

What is claimed is:

1. A method of beating a raw material in a refiner, comprising:

providing the refiner including a main body, a rotation shaft provided inside the main body, a rotor attached to the rotation shaft and having a mountain shape in which a center is high, the rotor having first and second opening portions, both ends of which are open, and a space therein, a stator provided in the main body to oppose the rotor, a rotor beating portion provided on a surface of the rotor except for a center of the rotor in a longitudinal direction, a stator beating portion provided on a surface of the stator, the stator beating portion opposing the rotor beating portion, a first raw material supply portion provided in the main body to supply a raw material from a side of the first opening portion, a second raw material supply portion provided in the main body to supply the raw material from a side of the second opening portion, and a raw material discharge portion for discharging the raw material beaten to an outside of the main body, wherein the rotor beating portion includes a first rotor beating portion provided on a surface thereof and a second rotor beating portion provided on the surface thereof, the first rotor beating portion comprises a bar, another bar, a groove between the bar and the another bar of the first rotor beating portion, and a plurality of through-holes penetrating through the first rotor beating portion, the bar and another bar crossing the plurality of through-holes, the second rotor beating portion comprises a bar, another bar, a groove between the bar and the another bar of the second rotor beating portion, and a plurality of through-holes penetrating through the second rotor beating portion, the bar and another bar crossing the plurality of through-holes, the stator beating portion includes a first stator beating portion provided on a surface thereof and a second stator beating portion provided on the surface thereof, the first stator beating portion comprises a bar, another bar, a groove between the bar and the another bar of the first stator beating portion, and a plurality of through-holes penetrating through the first stator beating portion, the bar and another bar crossing the plurality of through-holes, the second stator beating portion comprises a bar, another bar, a groove between the bar and the another bar of the second stator beating portion, and a plurality of through-holes penetrating through the second stator beating portion, the bar and another bar crossing the plurality of through-holes, the bar of the first rotor beating portion is inclined such that the raw material is guided from a small diameter side of the first rotor beating portion to a large diameter side of the first rotor beating portion, the bar of the second rotor beating portion is inclined such that the raw material is guided from a small diameter side of the second rotor beating portion to a large diameter side of the second rotor beating portion, a central opening portion is formed at a central portion of the stator beating portion, wherein the raw material from the first raw material supply portion approaches end portions of the first stator beating portion and the first rotor beating portion on a side close to the first raw material supply portion, and the first opening portion, the raw material from the second raw material supply portion approaches end portions of the second stator beating portion and the second rotor beating portion on a side close to the second raw material supply portion, and the second opening portion, the end portions of the first stator beating portion and the first rotor beating portion on a side far from the first raw material supply portion face the central opening portion, the end portions of the second stator beating portion and the second rotor beating portion on a side far from the second raw material supply portion face the central opening portion, and the plurality of through-holes of the first stator beating portion, the plurality of through-holes of the second stator beating portion, and the central opening portion communicate with the raw material discharge portion, beating a portion of the raw material guided to the first opening portion of the rotor and the space of the rotor is beaten by passing through the plurality of through-holes of the first rotor beating portion and the plurality of through-holes of the first stator beating portion thereby producing a beaten raw material (A), discharging the beaten raw material (A) to an outside of the first stator beating portion from the plurality of through-holes of the first stator beating portion, beating a portion of the raw material guided to the second opening portion of the rotor and the space of the rotor by passing through the plurality of through-holes of the second rotor beating portion and the plurality of through-holes of the second stator beating portion thereby producing a beaten raw material (B), discharging the beaten raw material (B) to an outside of the second stator beating portion from the plurality of through-holes of the second stator beating portion, beating a portion of the raw material guided to the first opening portion of the rotor and the space of the rotor passing through the plurality of through-holes of the first rotor beating portion on a side close to the large diameter side of the first rotor beating portion by passing through a gap between the first stator beating portion and the first rotor beating portion thereby producing a beaten raw material (C), discharging the beaten raw material (C) to an outside of the first stator beating portion and the first rotor beating portion through the central opening portion from the end portions of the first stator beating portion and the first rotor beating portion on the side far from the first raw material supply portion, beating a portion of the raw material guided to the second opening portion of the rotor and the space of the rotor passing through the plurality of through-holes of the second rotor beating portion on a side close to the large diameter side of the second rotor by passing through a gap between the second stator beating portion and the second rotor beating portion thereby producing a beaten raw material (D), discharging the beaten raw material (D) to an outside of the second stator beating portion and the second rotor beating portion through the central opening portion from the end portions of the second stator beating portion and the second rotor beating portion on the side far from the second raw material supply portion, beating the raw material guided to between the first stator beating portion and the first rotor beating portion on the small diameter side corresponding to the end portions on the side close to the first raw material supply portion by passing through the first stator beating portion and the first rotor beating portion thereby producing a beaten raw material (E), discharging the beaten raw material (E) to an outside of the first stator beating portion through the plurality of through-holes of the first stator beating portion, beating the raw material guided to between the second stator beating portion and the second rotor beating portion on the small diameter side corresponding to the end portions on the side close to the second raw material supply portion by passing through the second stator beating portion and the second rotor beating portion thereby producing a beaten raw material (F), and discharging the beaten raw material (F) to an outside of the second stator beating portion from the plurality of second' through-holes of the second stator beating portion.

2. The method according to claim 1, wherein the rotor includes a first tapered rotor and a second tapered rotor, a small diameter side of the first tapered rotor corresponds to the first opening portion of the rotor, a large diameter side of the first tapered rotor is closed, a small diameter side of the second tapered rotor corresponds to the second opening portion of the rotor, a large diameter side of the second tapered rotor is closed, and the large diameter side of the first tapered rotor and the large diameter side of the second tapered rotor oppose each other, and are attached to the rotation shaft.

3. The method according to claim 1, wherein the bar and the another bar of each of the first and second rotor beating portions are installed across the through-hole of each of the first and second rotor beating portions and/or the bar and the another bar of each of the first and second stator beating portions are installed across the through-hole of each of the first and second stator beating portions.

4. A method of beating a raw material in a refiner, comprising:

providing the refiner including a main body, a rotation shaft provided inside the main body, a rotor attached to the rotation shaft and having a mountain shape in which a center is high, the rotor having first and second opening portions, both ends of which are open, and a space therein, a stator provided in the main body to oppose the rotor, a rotor beating portion provided on a surface of the rotor except for a center of the rotor in a longitudinal direction, a stator beating portion provided on a surface of the stator, the stator beating portion opposing the rotor beating portion, a raw material supply portion for supplying a raw material, the raw material supply portion being provided in the main body and being closer to the first opening portion than to the second opening portion, and a raw material discharge portion for discharging the raw material beaten to an outside of the main body, wherein the rotor beating portion includes a first rotor beating portion provided on a surface thereof and a second rotor beating portion provided on the surface thereof, the first rotor beating portion comprises a bar, another bar, a groove between the bar and the another bar of the first rotor beating portion, and a plurality of through-holes penetrating through the first rotor beating portion, the bar and another bar crossing the plurality of through-holes, the second rotor beating portion comprises a bar, another bar, a groove between the bar and the another bar of the second rotor beating portion, and a plurality of through-holes penetrating through the second rotor beating portion, the bar and another bar crossing the plurality of through-holes, the stator beating portion includes a first stator beating portion provided on a surface thereof and a second stator beating portion provided on the surface thereof, the first stator beating portion comprises a bar, another bar, a groove between the bar and the another bar of the first stator beating portion, and a plurality of through-holes penetrating through the first stator beating portion, the bar and another bar crossing the plurality of through-holes, the second stator beating portion comprises a bar, another bar, a groove between the bar and the another bar of the second stator beating portion, and a plurality of through-holes penetrating through the second stator beating portion, the bar and another bar crossing the plurality of through-holes, the bar of the first rotor beating portion is inclined such that the raw material is guided from a small diameter side of first rotor beating portion to a large diameter side of the first rotor beating portion, the second bar of the second rotor beating portion is inclined such that the raw material is guided from a small diameter side of the second rotor beating portion to a large diameter side of the second rotor beating portion, a central opening portion is formed at a central portion of the stator beating portion, the raw material from the raw material supply portion approaches end portions of the first stator beating portion and the first rotor beating portion on a side close to the raw material supply portion, and the first opening portion, the end portions of the first stator beating portion and the first rotor beating portion on the large diameter side face the central opening portion, end portions of the second stator beating portion and the second rotor beating portion on the large diameter side face the central opening portion, and the plurality of through-holes of the first stator beating portion, the plurality of through-holes of the second stator beating portion, and the central opening portion communicate with the raw material discharge portion, wherein beating a portion of the raw material guided to the first opening portion of the rotor and the space of the rotor by passing through the plurality of through-holes of the first rotor beating portion and the plurality of through-holes of the first stator beating portion thereby producing a beaten raw material (A), discharging the beaten raw material (A) to an outside of the first stator beating portion from the plurality of through-holes of the first stator beating portion, beating a portion of the raw material guided to the space of the rotor by passing through the plurality of through-holes of the second rotor beating portion and the plurality of through-holes of the second stator beating portion thereby producing a beaten raw material (B), discharging the beaten raw material (B) to an outside of the second stator beating portion from the plurality of through-holes of the second stator beating portion, beating a portion of the raw material guided to the first opening portion of the rotor and the space of the rotor passing through the plurality of through-holes of the first rotor beating portion on a side close to the large diameter side of the first rotor by passing through a gap between the first stator beating portion and the first rotor beating portion thereby producing a beaten raw material (C), discharging the beaten raw material (C) to an outside of the first stator beating portion and the first rotor beating portion through the central opening portion from the end portions of the first stator beating portion and the first rotor beating portion on the large diameter side, beating a portion of the raw material guided to the space of the rotor passing through the plurality of through-holes of the second rotor beating portion on a side close to the large diameter side of the second rotor by passing through a gap between the second stator beating portion and the second rotor beating portion thereby producing a beaten raw material (D), discharging the beaten raw material (D) to an outside of the second stator beating portion and the second rotor beating portion through the central opening portion from the end portions of the second stator beating portion and the second rotor beating portion on the large diameter side, beating the raw material guided to between the first stator beating portion and the first rotor beating portion on the small diameter side corresponding to end portions on the side close to the raw material supply portion by passing through the first stator beating portion and the first rotor beating portion thereby producing a beaten raw material (E), discharging the beaten raw material (E) to an outside of the first stator beating portion through the plurality of through-holes of the first stator beating portion, beating a portion of the raw material discharged from the second opening portion colliding with an inner wall of the main body opposing the second opening portion, and guided to between the second stator beating portion and the second rotor beating portion on the small diameter side corresponding to end portions on a side close to the inner wall of the main body opposing the second opening portion by passing through the second stator beating portion and the second rotor beating portion thereby producing a beaten raw material (F), and discharging the beaten raw material (F) to an outside of the second stator beating portion from the plurality of through-holes of the second stator beating portion.

5. A method of beating a raw material in a refiner, comprising:

providing the refiner including a main body, a rotation shaft provided inside the main body, a rotor attached to the rotation shaft and having a mountain shape in which a center is high, the rotor having first and second opening portions, both ends of which are open, and a space therein, a stator provided in the main body to oppose the rotor, a rotor beating portion provided on a surface of the rotor except for a center of the rotor in a longitudinal direction, a stator beating portion provided on a surface of the stator, the stator beating portion opposing the rotor beating portion, a first raw material supply portion provided in the main body to supply a raw material from a side of the first opening portion, a second raw material supply portion provided in the main body to supply the raw material from a side of the second opening portion, and a raw material discharge portion for discharging the raw material beaten to an outside of the main body, wherein the rotor beating portion includes a first rotor beating portion provided on a surface thereof and a second rotor beating portion provided on the surface thereof, the first rotor beating portion comprises a bar, another bar, a groove between the bar and the another bar of the first rotor beating portion, and a plurality of through-holes penetrating through the first rotor beating portion, the bar and another bar crossing the plurality of through-holes, the second rotor beating portion comprises a bar, another bar, a groove between the bar and the another bar of the second rotor beating portion, and a plurality of through-holes penetrating through the second rotor beating portion, the bar and another bar crossing the plurality of through-holes, the stator beating portion includes a first stator beating portion provided on a surface thereof and a second stator beating portion provided on the surface thereof, the first stator beating portion comprises a bar, another bar, a groove between the bar and the another bar of the first stator beating portion, and a plurality of through-holes penetrating through the first stator beating portion, the bar and another bar crossing the plurality of through-holes, the second stator beating portion comprises a bar, another bar, a groove between the bar and the another bar of the second stator beating portion, and a plurality of through-holes penetrating through the second stator beating portion, the bar and another bar crossing the plurality of through-holes, the bar of the first rotor beating portion is inclined such that the raw material is guided from a large diameter side of first rotor beating portion to a small diameter side of the first rotor beating portion, the bar of the second rotor beating portion is inclined such that the raw material is guided from a large diameter side of second rotor beating portion to a small diameter side of the second rotor beating portion, a central opening portion is formed at a central portion of the stator beating portion, end portions of the first stator beating portion and the first rotor beating portion on a side far from the first raw material supply portion face the central opening portion, end portions of the second stator beating portion and the second rotor beating portion on a side far from the second raw material supply portion face the central opening portion, the raw material from the first raw material supply portion approaches the end portions of the first stator beating portion and the first rotor beating portion on a side close to the first raw material supply portion, and the first opening portion, the raw material from the second raw material supply portion approaches the end portions of the second stator beating portion and the second rotor beating portion on a side close to the second raw material supply portion, and the second opening portion, the plurality of through-holes of the first stator beating portion, the plurality of through-holes of the second stator beating portion, and the central opening portion communicate with the raw material discharge portion, beating a portion of the raw material supplied from the first raw material supply portion by passing through the first opening portion, the space of the rotor, the plurality of through-holes of the first rotor beating portion, and the plurality of through-holes of the first stator beating portion thereby producing a beaten raw material (A), discharging the beaten raw material (A) to an outside of the first stator beating portion from the plurality of through-holes of the first stator beating portion, beating a portion of the raw material supplied from the second raw material supply portion by passing through the second opening portion, the space of the rotor, the plurality of through-holes of the second rotor beating portion, and the plurality of through-holes of the second stator beating portion thereby producing a beaten raw material (B), discharging the beaten raw material (B) to an outside of the second stator beating portion from the plurality of through-holes of the second stator beating portion, beating a portion of the raw material discharged to the outside of the first stator beating portion from the plurality of through-holes of the first stator beating portion by guiding to between the first stator beating portion and the first rotor beating portion from the end portions of the first stator beating portion and the first rotor beating portion on the side far from the first raw material supply portion through the central opening portion thereby producing a beaten raw material (C), discharging the beaten raw material (C) to the outside of the first stator beating portion from the plurality of through-holes of the first stator beating portion on a side close to the large diameter side of the first rotor, beating a portion of the raw material discharged to the outside of the second stator beating portion from the through-holes of the second stator beating portion by guiding to between the second stator beating portion and the second rotor beating portion from the end portions of the second stator beating portion and the second rotor beating portion on the side far from the second raw material supply portion through the central opening portion thereby producing a beaten raw material (D), discharging the beaten raw material (D) to the outside of the second stator beating portion from the plurality of through-holes of the second stator beating portion on a side close to the large diameter side of the second rotor, beating a portion of the raw material introduced to the first stator beating portion and the first rotor beating portion from the plurality of through-holes of the first rotor beating portion on a side close to the small diameter side of the first rotor, returned to the small diameter side of the first rotor, discharged from the end portions of the first stator beating portion and the first rotor beating portion on the side close to the first raw material supply portion, joining the raw material supplied from the first raw material supply portion by passing through the first opening portion of the rotor, the space of the rotor, the plurality of through-holes of the first rotor beating portion, and the plurality of through-holes of the first stator beating portion thereby producing a beaten raw material (E), discharging the beaten raw material (E) to the outside of the first stator beating portion from the plurality of through-holes of the first stator beating portion, beating a portion of the raw material introduced to the second stator beating portion and the second rotor beating portion from the plurality of through-holes of the second rotor beating portion on a side close to the small diameter side of the second rotor returned to the small diameter side of the second rotor, discharged from the end portions of the second stator beating portion and the second rotor beating portion on the side close to the second raw material supply portion, joining the raw material supplied from the second raw material supply portion by passing through the second opening portion of the rotor, the space of the rotor, the plurality of through-holes of the second rotor beating portion, and the plurality of through-holes of the second stator beating portion thereby producing a beaten raw material (F), and discharging the beaten raw material (F) to the outside of the second stator beating portion from the plurality of through-holes of the second stator beating portion.

6. A method of beating a raw material in a refiner, comprising:

providing the refiner including a main body, a rotation shaft provided inside the main body, a tapered rotor attached to the rotation shaft, and having a space inside the rotor, a stator provided in the main body to oppose the rotor, a rotor beating portion provided on a surface of the rotor, the rotor beating portion having a bar, another bar, a groove between the bar and the another bar, and a plurality of through-holes penetrating there through, the bar and another bar crossing the plurality of through-holes, a stator beating portion provided on a surface of the stator, the stator beating portion opposing the rotor beating portion, and having a bar, another bar, a groove between the bar and the another bar, and a plurality of through-holes penetrating there through, the bar and another bar crossing the plurality of through-holes, a raw material supply portion for supplying a raw material into the main body, and a raw material discharge portion for discharging the raw material beaten to an outside of the main body, wherein the raw material from the raw material supply portion approaches end portions of the stator beating portion and the rotor beating portion on a side close to the raw material supply portion, and a small-diameter opening portion of the rotor, the plurality of through-holes of the stator beating portion and end portions of the stator beating portion and the rotor beating portion on a side far from the raw material supply portion communicate with the raw material discharge portion, a small diameter side of the rotor is the small-diameter opening portion, a large diameter side of the rotor is a large-diameter opening portion which has a closed end, and the bar and the another of the rotor beating portion are inclined such that the raw material is guided from the large diameter side of the rotor to the small diameter side of the rotor, discharging the raw material beaten by passing through the small-diameter opening portion of the rotor, the space of the rotor, the plurality of through-holes of the rotor beating portion, and the plurality of through-holes of the stator beating portion to an outside of the stator beating portion from the plurality of through-holes of the stator beating portion, beating a portion of the raw material discharged to the outside of the stator beating portion from the through-holes of the stator beating portion by guiding to between the stator beating portion and the rotor beating portion from the end portions of the stator beating portion and the rotor beating portion on the side far from the raw material supply portion thereby producing a beaten raw material (A), discharging the beaten raw material (A) to the outside of the stator beating portion from the plurality of through-holes of the stator beating portion on a side close to the large diameter side of the rotor, beating a portion of the raw material introduced to the stator beating portion and the rotor beating portion from the plurality of through-holes of the rotor beating portion on a side close to the small diameter side of the rotor, returned to the small diameter side of the rotor, discharged from the end portions of the stator beating portion and the rotor beating portion on the side close to the raw material supply portion, joining the raw material supplied from the raw material supply portion by passing through the small-diameter opening portion of the rotor, the space of the rotor, the plurality of through-holes of the rotor beating portion, and the plurality of through-holes of the stator beating portion thereby producing a beaten raw material (B), and discharging the beaten raw material (B) to the outside of the stator beating portion from the plurality of through-holes of the stator beating portion.

* * * * *